US010894628B2

(12) United States Patent
Buscema

(10) Patent No.: US 10,894,628 B2
(45) Date of Patent: Jan. 19, 2021

(54) SAG-RESISTANT CONTAINERS AND BLANKS FOR MAKING THE SAME

(71) Applicant: WestRock Shared Services, LLC, Norcross, GA (US)

(72) Inventor: Craig W. Buscema, Douglasville, PA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/584,042

(22) Filed: Sep. 26, 2019

(65) Prior Publication Data

US 2020/0017255 A1 Jan. 16, 2020

Related U.S. Application Data

(62) Division of application No. 15/417,458, filed on Jan. 27, 2017, now Pat. No. 10,457,439.

(60) Provisional application No. 62/289,650, filed on Feb. 1, 2016.

(51) Int. Cl.

| | |
|---|---|
| ***B65D 5/44*** | (2006.01) |
| ***B65D 5/00*** | (2006.01) |
| ***B65D 5/20*** | (2006.01) |
| ***B65D 5/42*** | (2006.01) |

(52) U.S. Cl.

CPC ..... *B65D 5/443* (2013.01); *B65D 5/001* (2013.01); *B65D 5/003* (2013.01); *B65D 5/20* (2013.01); *B65D 5/4266* (2013.01)

(58) Field of Classification Search

CPC ..... B65D 5/443; B65D 5/001; B65D 5/003; B65D 5/20; B65D 5/4266

See application file for complete search history.

(56) References Cited

U.S. PATENT DOCUMENTS

| | | | | |
|---|---|---|---|---|
| 4,101,048 | A * | 7/1978 | Rieben | B65D 5/0045 229/117.16 |
| 2009/0145955 | A1* | 6/2009 | McLeod | B65D 5/6638 229/169 |
| 2014/0084047 | A1* | 3/2014 | McLeod | B65D 5/003 229/109 |
| 2015/0251797 | A1* | 9/2015 | Carman | B65D 5/304 229/148 |
| 2016/0347496 | A1* | 12/2016 | Carman | B65D 5/003 |
| 2016/0347498 | A1* | 12/2016 | Lambert | B65D 5/6652 |
| 2016/0368652 | A1* | 12/2016 | Makiuchi | B65D 5/2047 |
| 2017/0152096 | A1* | 6/2017 | Chang | B65D 5/4279 |

* cited by examiner

*Primary Examiner* — Derek J Battisti
(74) *Attorney, Agent, or Firm* — John Swingle

(57) ABSTRACT

A container formed from a blank and a method for constructing the container are described. The container includes a bottom wall, two end walls, each end wall including at least an end panel extending from an end edge of the bottom wall, and two side walls. The container further includes an upper reinforcing assembly at least partially extending from each end panel, and a side reinforcing assembly extending from opposing side edges of each end panel.

4 Claims, 8 Drawing Sheets

SAG-RESISTANT CONTAINERS AND BLANKS FOR MAKING THE SAME

REFERENCE TO RELATED APPLICATION

This application is a divisional of U.S. patent application Ser. No. 15/417,458, filed Jan. 27, 2017, which claims priority to U.S. Provisional Patent Application No. 62/289,650, filed on Feb. 1, 2016, the disclosures of both of which are hereby incorporated by reference in their entirety.

BACKGROUND

The embodiments described herein relate generally to a blank and a reinforced container formed from the blank and, more particularly, to a blank having a reinforcing panel assembly configured to reinforce a corner portion of the container to produce a sag-resistant container.

Containers are frequently utilized to store and transport products. In at least some known cases, a blank of sheet material is used to form these containers. More specifically, these known containers are formed by folding a plurality of panels of the blank along preformed fold lines. To form at least some known containers, some of the panels are secured using an adhesive. Such known containers may be formed using a machine and/or by hand.

At least some such containers have certain strength requirements for storing and transporting products. These strength requirements may include a stacking strength requirement such that the containers can be stacked on one another during transport without collapsing. To meet these strength requirements, at least some known containers include reinforcing walls near the corners of the container for providing additional strength, including stacking strength. At least some known containers have reinforcing panels that are attached to an interior surface of the corners of the formed container. However, such containers can be expensive to produce with the extra reinforcing panels and are less than optimal for certain applications. For example, these known containers with extra reinforcing panels are less than optimal for storing and transporting fresh fruit or produce because the interior reinforced panels create interior edges or non-planar interior surfaces that can damage or "bruise" the produce contained in the container.

BRIEF DESCRIPTION

In one aspect, a container formed from a blank is provided. The container includes a bottom wall, two opposing end walls, each end wall including at least an end panel extending from an end edge of the bottom wall, and two opposing side walls. The container further includes an upper reinforcing assembly at least partially extending from each end panel, and a side reinforcing assembly extending from opposing side edges of each end panel.

In another aspect, a method for forming a container from a blank is provided. The blank includes a bottom panel, two opposing end panels each extending from an end edge of the bottom panel, and two opposing side panels each extending from a side edge of the bottom panel. The blank further includes an upper reinforcing assembly at least partially extending from each end panel, and a side reinforcing assembly extending from opposing side edges of each end panel. The method includes rotating each end panel inwardly into a substantially perpendicular relationship with the bottom panel, rotating each side panel into a substantially perpendicular relationship with the bottom panel, and rotating the side reinforcing assembly into a substantially perpendicular relationship with one of the two end panels. The method further includes rotating the upper reinforcing assembly into a substantially perpendicular relationship with one of the two end panels, and securing the side reinforcing assembly and the upper reinforcing assembly to at least one of the two side panels to form the container.

In yet another aspect, a blank for constructing a container is provided. The blank includes a bottom panel, and a plurality of side panels extending from the bottom panel. The plurality of side panels includes a first end panel extending from a first end edge of the bottom panel and a first side panel extending from a first side edge of the bottom panel. The blank further includes a first side reinforcing assembly extending from a first side edge of the first end panel, and a first upper reinforcing assembly at least partially extending from a first end edge of the first end panel.

DETAILED DESCRIPTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The embodiments described herein provide a stackable, reinforced container formed from a single sheet of blank material, and a method for constructing the container. The containers described herein are reinforced as sag-resistant containers. The container may be constructed from a blank of sheet material using a machine and/or by hand. In one embodiment, the blank is fabricated from a corrugated cardboard material. The blank, however, may be fabricated using any suitable material, and therefore is not limited to a specific type of material. In alternative embodiments, the blank is fabricated using cardboard, plastic, fiberboard, paperboard, foamboard, corrugated paper, and/or any suitable material known to those skilled in the art and guided by the teachings herein provided.

In an example embodiment, the blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the blank is void of markings, such as, without limitation, indicia that communicates the product, a manufacturer of the product and/or a seller of the product.

Figure 1:
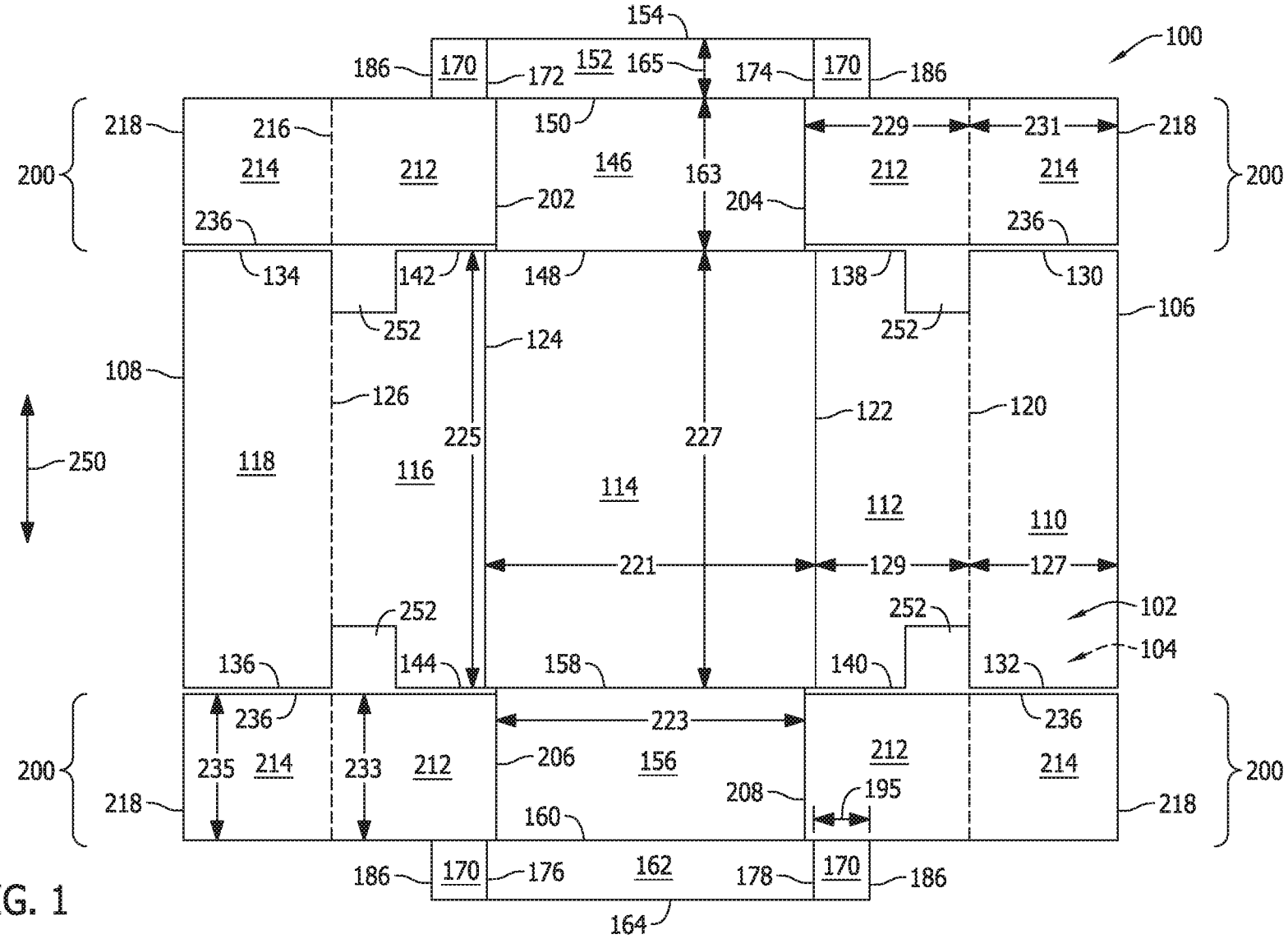
FIG. 1 is a top plan view of an example embodiment of a blank of sheet material for constructing a sag-resistant container.
Figure 2:
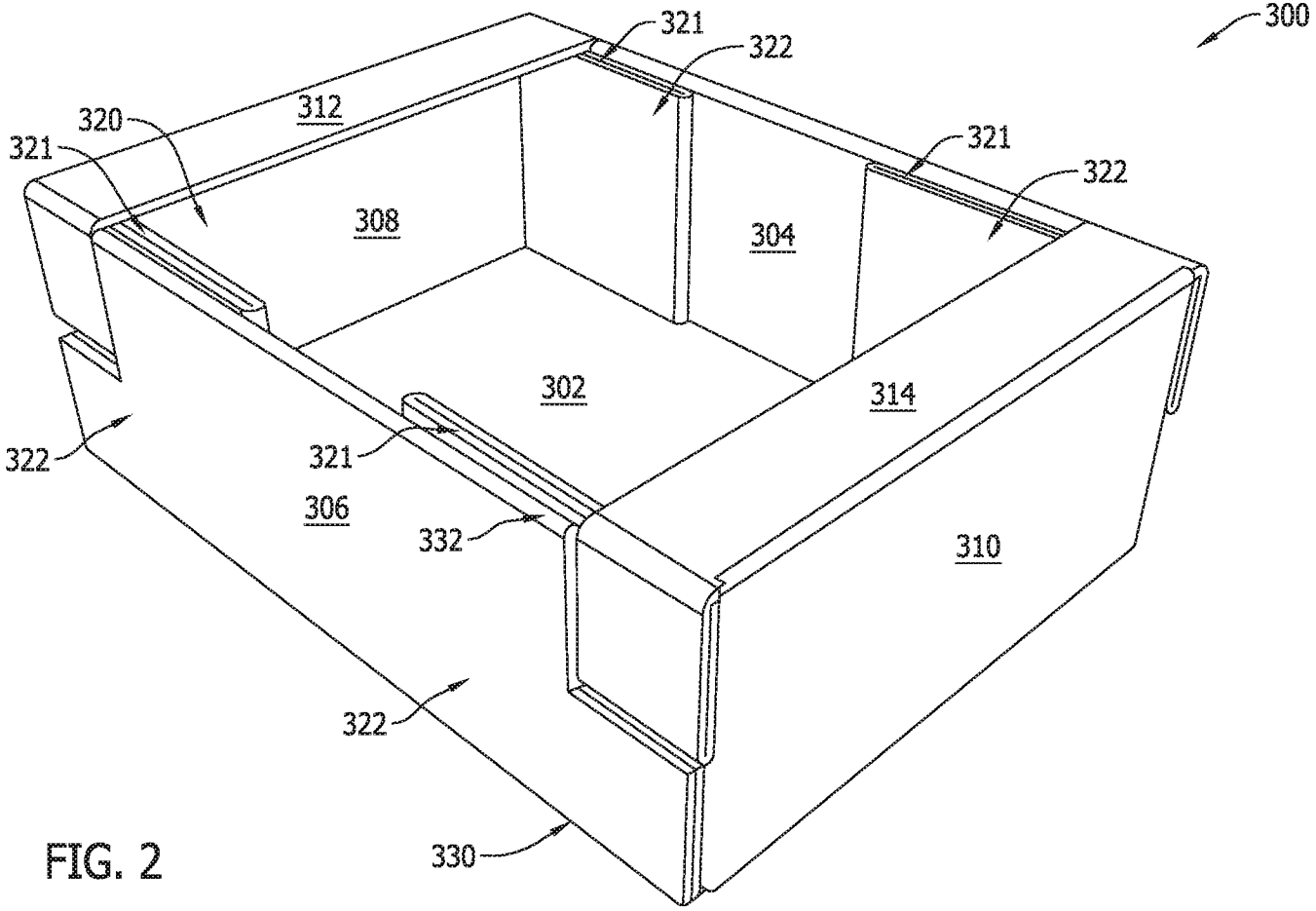
FIG. 2 is a perspective view of an example embodiment of the container formed from the blank shown in FIG. 1.
Figure 3:
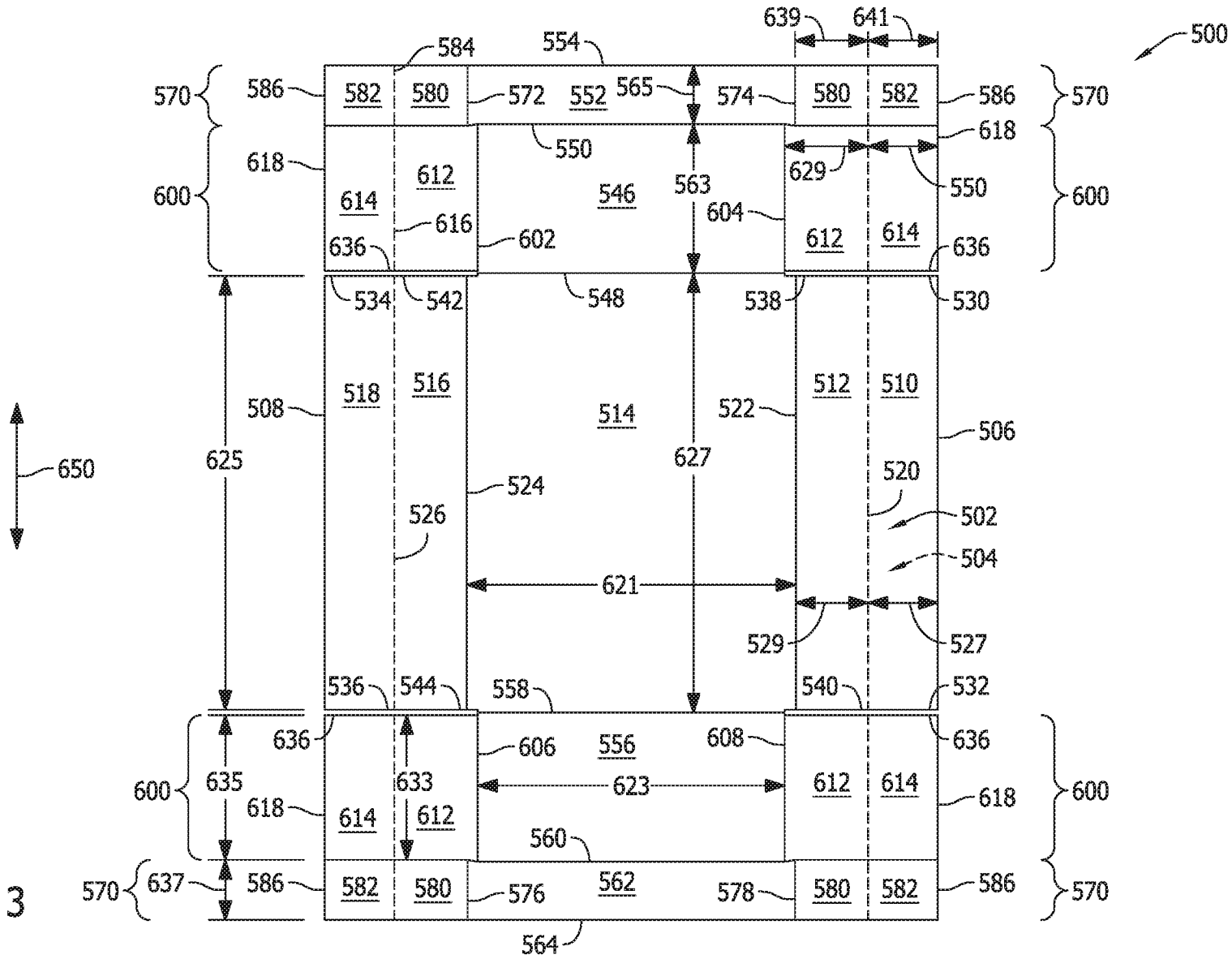
FIG. 3 is a top plan view of another example embodiment of a blank of sheet material for constructing another sag-resistant container.
Figure 4:
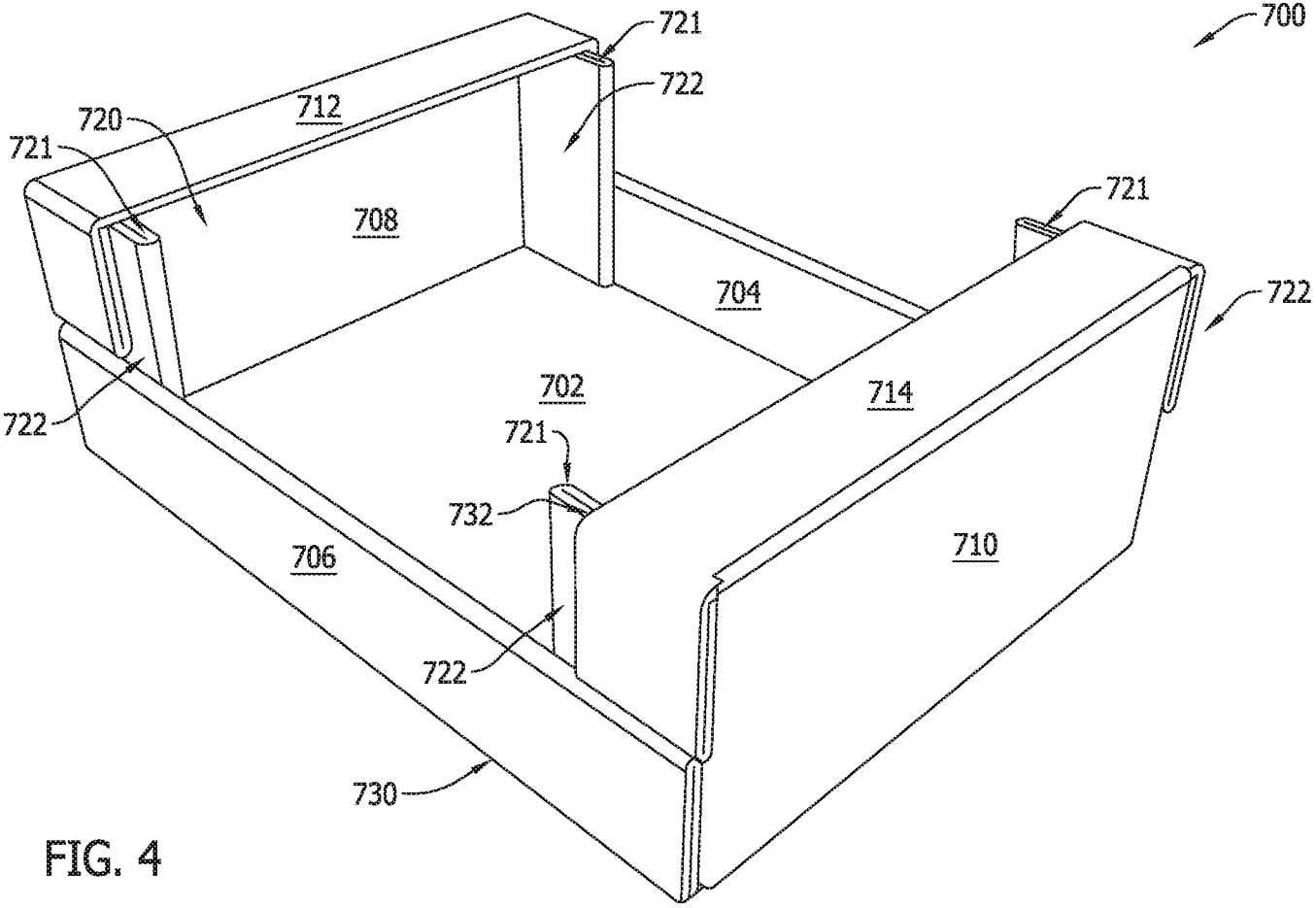
FIG. 4 is a perspective view of another example embodiment of the container formed from the blank shown in FIG. 3.
Figure 5:
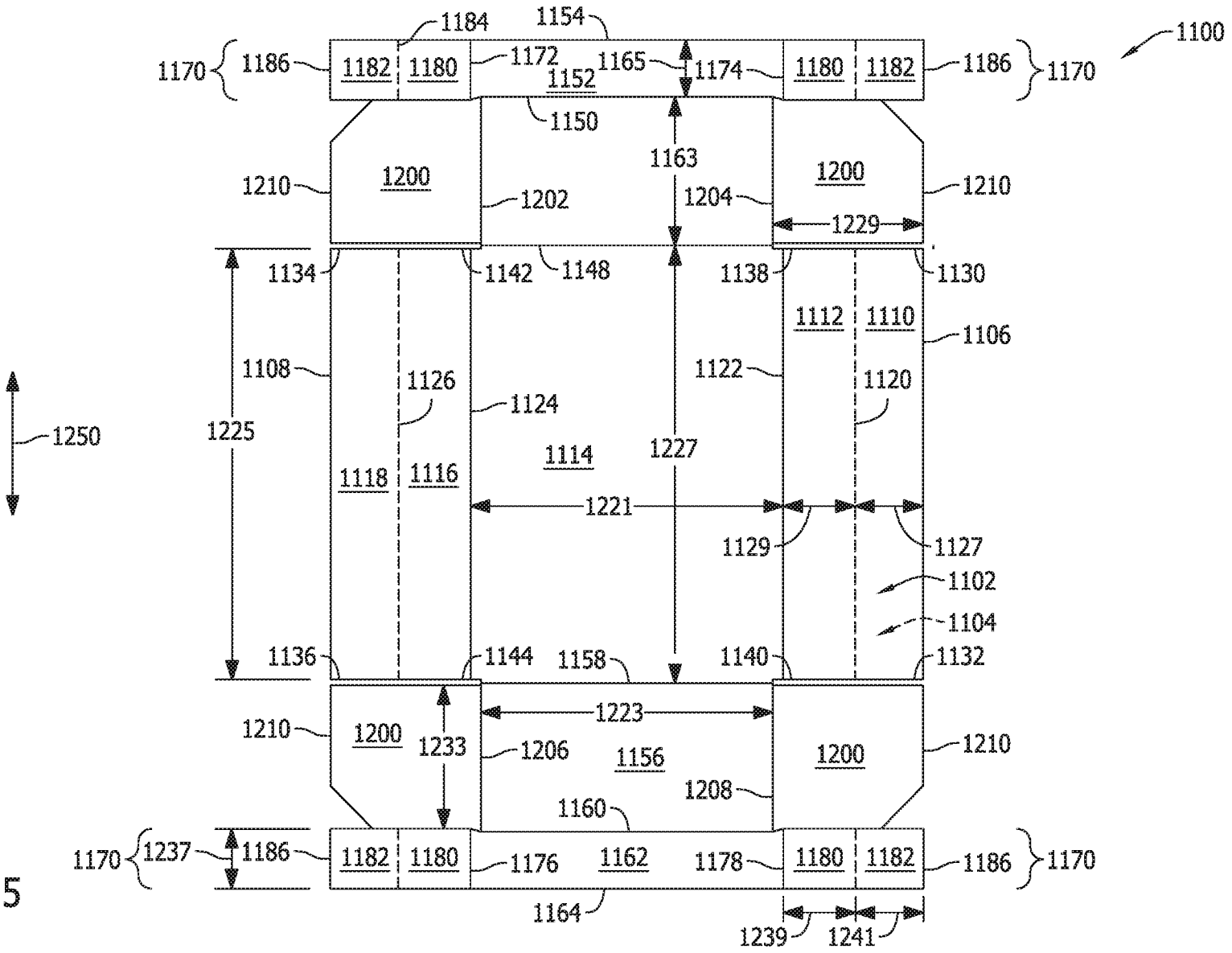
FIG. 5 is a top plan view of yet another example embodiment of a blank of sheet material for constructing a sag-resistant container.
Figure 6:
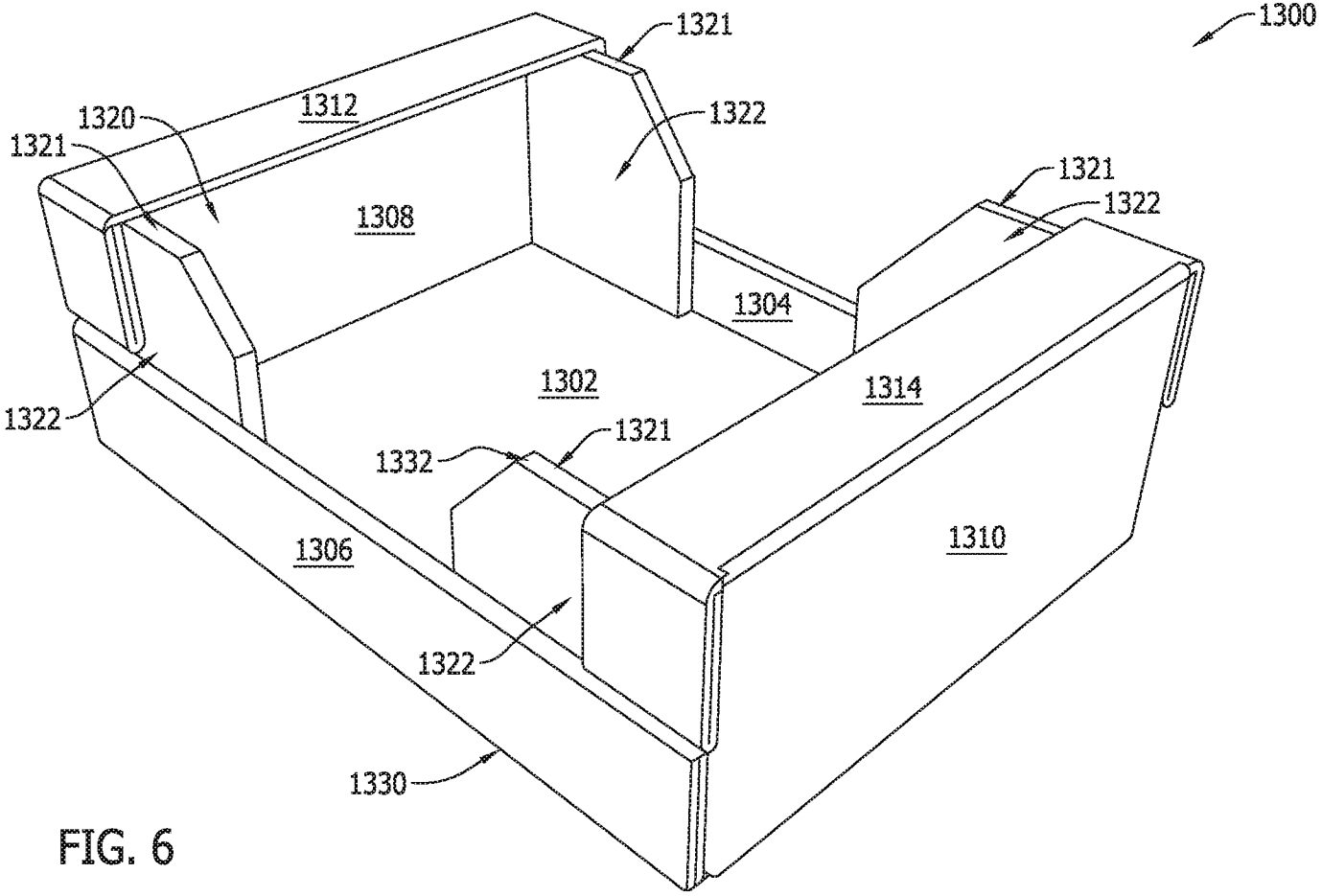
FIG. 6 is a perspective view of yet another example embodiment of the container formed from the blank shown in FIG. 5.
Figure 7:
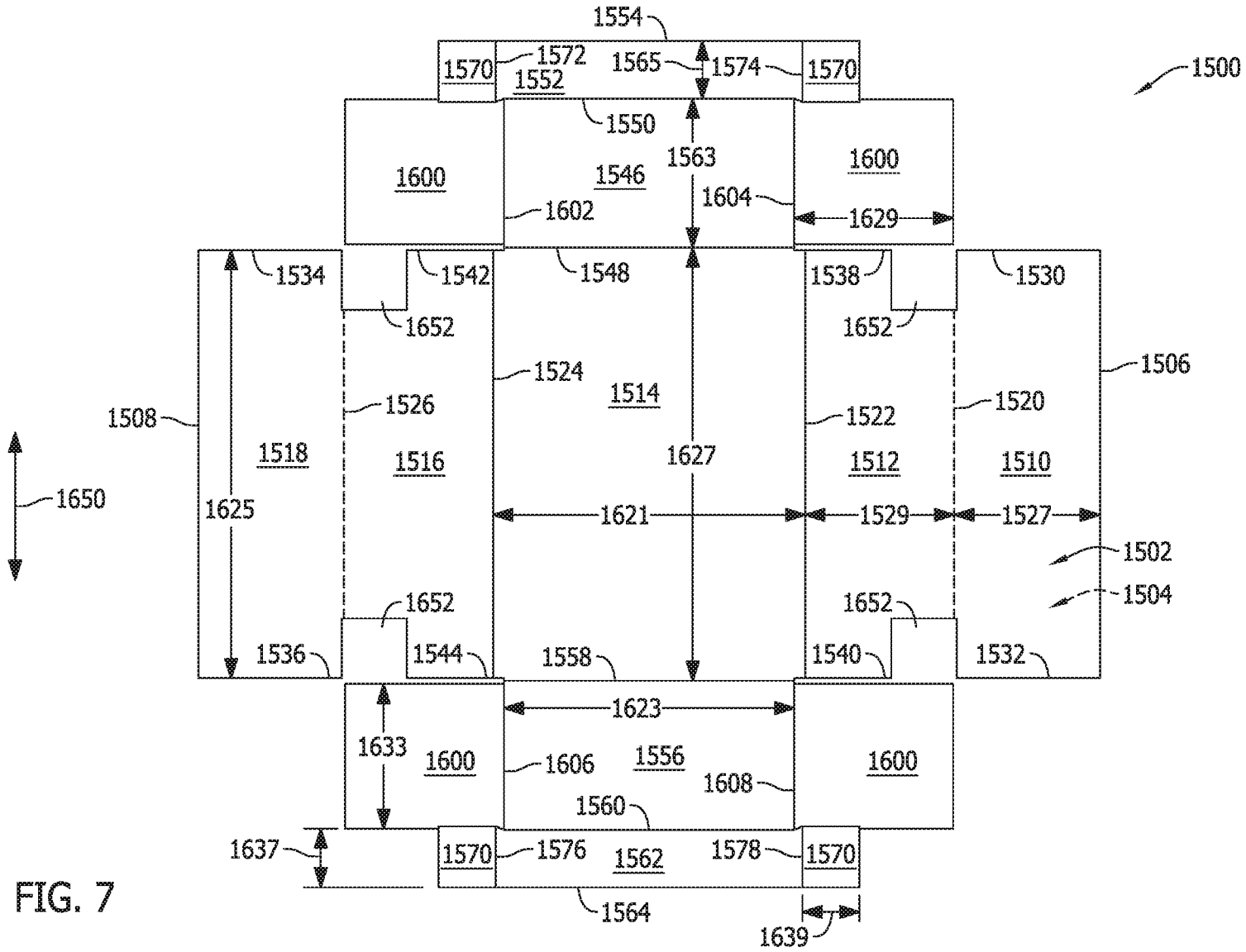
FIG. 7 is a top plan view of yet another example embodiment of a blank of sheet material for constructing another sag-resistant container.
Figure 8:
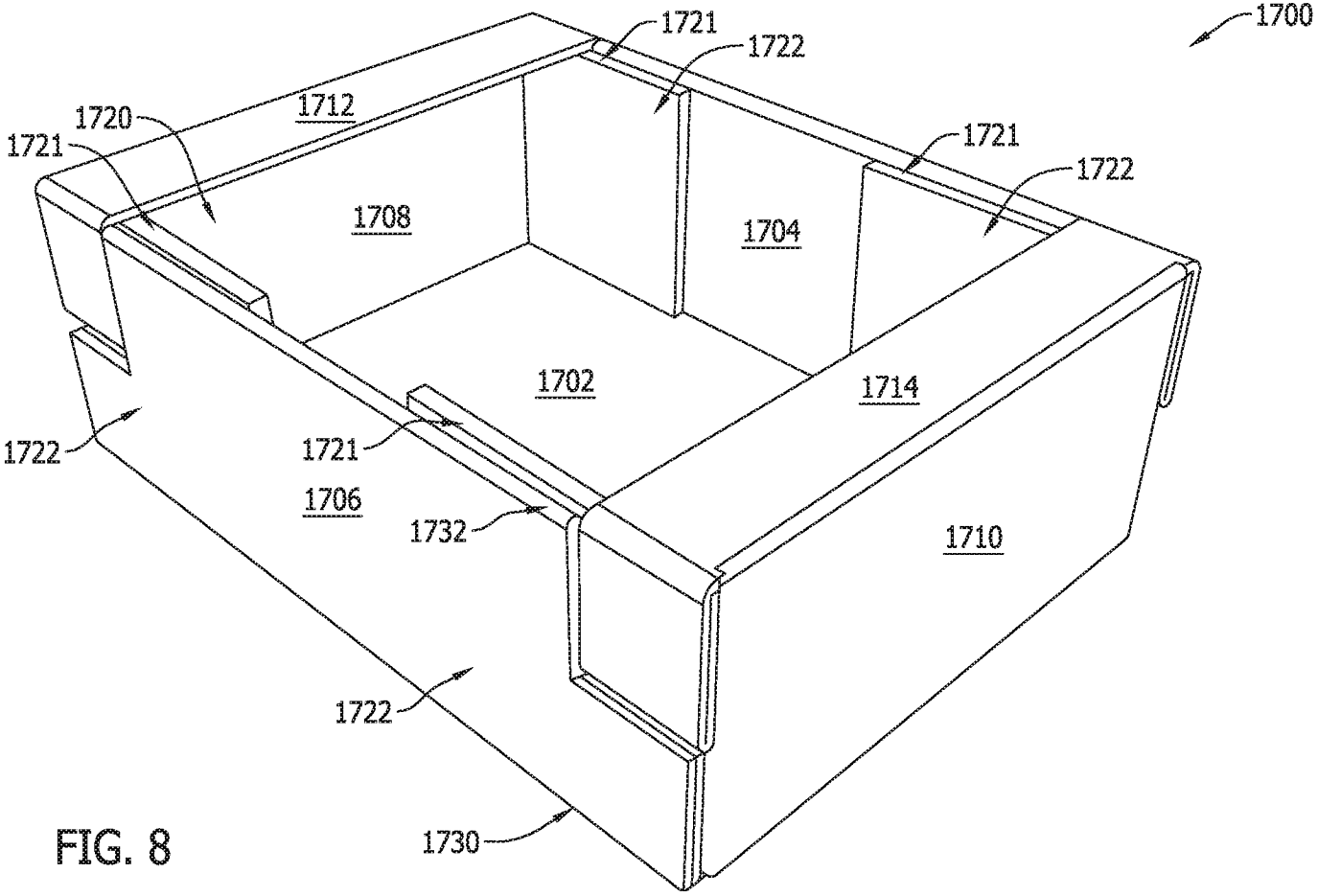
FIG. 8 is a perspective view of yet another example embodiment of the container formed from the blank shown in FIG. 7.

Reference will now be made to the drawings, and more specifically to FIG. 1, which is a top plan view of an example embodiment of a blank 100 of sheet material. FIG. 2 is a perspective view of an example embodiment of a container 300 formed from blank 100. FIG. 3 is a top plan view of another example embodiment of a blank 500 of sheet material. FIG. 4 is a perspective view of another example embodiment of a container 700 formed from blank 500. FIG. 5 is a top plan view of yet another example embodiment of a blank 1100 of sheet material. FIG. 6 is a perspective view of yet another example embodiment of a container 1300 formed from blank 1100. FIG. 7 is a top plan view of yet another example embodiment of a blank 1500 of sheet material. FIG. 8 is a perspective view of yet another example embodiment of a container 1700 formed from blank 1500.

Blank 100 has a first or interior surface 102 and an opposing second or exterior surface 104. Further, blank 100 defines a leading edge 106 and an opposing trailing edge 108. In one embodiment, blank 100 includes, in series from leading edge 106 to trailing edge 108, a plurality of side panels (at least some of which may be referred to as "end panels"), including, specifically, a first rollover panel 110 (or first inner side panel), a first side panel 112 (or first outer side panel), a bottom panel 114, a second side panel 116 (or second outer side panel), and a second rollover panel 118 (or second inner side panel) coupled together along preformed, generally parallel, fold lines 120, 122, 124, and 126 respectively. More specifically, first rollover panel 110 extends between leading edge 106 and fold line 120, first side panel 112 extends from fold line 120, bottom panel 114 extends from fold line 122, second side panel 116 extends from fold line 124, and second rollover panel 118 extends between fold line 126 and trailing edge 108. Fold line 120 defines a top edge of first rollover panel 110 and a top edge of first side panel 112 when the container is formed. Fold line 122 defines a bottom edge of first side panel 112 and a first side edge of bottom panel 114. Fold line 124 defines a bottom edge of second side panel 116 and a second side edge of bottom panel 114. Fold line 126 defines a top edge of second rollover panel 118 and a top edge of second side panel 116. Fold lines 120, 122, 124, and 126 as well as other fold lines and/or hinge lines described herein, may include any suitable line of weakening and/or line of separation known to those skilled in the art and guided by the teachings herein provided.

In the example embodiment, first rollover panel 110 and first side panel 112 are substantially congruent and have a rectangular shape, second rollover panel 118 and second side panel 116 are substantially congruent and have a rectangular shape, and bottom panel 114 has a substantially rectangular shape. Moreover, rollover panels 110 and 118 each have a height 127, and side panels 112 and 116 each have a height 129 that is slightly greater than height 127 by approximately a thickness of blank 100, to accommodate rollover panels 110, 118 being positioned in an overlying relationship with side panels 112 and 116, respectively, when container 300 (shown in FIG. 2) is formed from blank 100. In alternative embodiments, first rollover panel 110 and first side panel 112 are other than substantially congruent, and/or second rollover panel 118 and second side panel 116 are other than substantially congruent. Moreover, in alternative embodiments, each of rollover panels 110 and 118 and side panels 112 and 116 have any suitable height that enables blank 100 to function as described herein.

In the example embodiment, first rollover panel 110 includes two free end edges 130 and 132, and second rollover panel 118 includes two free end edges 134 and 136. First side panel 112 includes two free end edges 138 and 140, and second side panel 116 includes two free end edges 142 and 144. Free edges 130, 132, 134, 136, 138, 140, 142, and 144 are generally parallel to each other. In alternative embodiments, free end edges 130, 132, 134, 136, 138, 140, 142, and 144 may be other than substantially parallel to each other.

A first end panel 146 extends from bottom panel 114 along a fold line 148 to a fold line 150, and a first top end flap 152 extends from fold line 150 to a free edge 154. A second end panel 156 extends from bottom panel 114 along a fold line 158 to a fold line 160, and a second top end flap 162 extends from fold line 160 to a free edge 164. Fold line 148 defines a bottom edge of first end panel 146 and a first end edge of bottom panel 114. Fold line 150 defines a top edge of first end panel 146. Fold line 158 defines a bottom edge of second end panel 156 and a second end edge of bottom panel 114. Fold line 160 defines a top edge of second end panel 156. In the example embodiment, first and second end panels 146 and 156 each have a generally rectangular shape, and each have a height 163 that is approximately equal to height 129. In the example embodiment, first and second top end flaps 152 and 162 each have a generally rectangular shape, and each have a width 165 that is less than height 163. In alternative embodiments, each of end panels 146 and 156 and each of top end flaps 152 and 162 have any suitable shape and height that enables blank 100 to function as described herein.

A top side flap 170 extends from each opposing end edge of each of top end flaps 152 and 162. Each side edge of top end flaps 152 and 162 is defined by a respective one of fold lines 172, 174, 176, and 178. In the example embodiment, fold lines 172, 174, 176, and 178 are generally parallel to each other and to fold lines 120, 122, 124, and 126. In alternative embodiments, fold lines 172, 174, 176, and 178 may be other than substantially parallel to each other and/or to fold lines 120, 122, 124, and/or 126. In the example embodiment, each top side flap 170 is substantially similar and extends form a respective one of top end flaps 152 and 162 to along one of fold lines 172, 174, 176, and 178 to a free edge 186. In alternative embodiments, each top side flap 170 has any suitable shape that enables blank 100 to function as described herein. Together, each of the top end flaps 152 and 162 and the respective top side flaps 170 define upper reinforcing assemblies. In other words, one upper reinforcing assembly includes top end flap 152 and top side flaps 170 extending along fold lines 172 and 174, and another upper reinforcing assembly includes top end flap 162 and top side flaps 170 extending along fold lines 176 and 178.

A reinforcing panel assembly 200 (or side reinforcing assembly) extends from each opposing side edge of each end panel 146 and 156. Reinforcing panel assembly 200 includes a plurality of panels as will be described herein. Each side edge of end panels 146 and 156 is defined by a respective one of fold lines 202, 204, 206, and 208. In the example embodiment, fold lines 202, 204, 206, and 208 are generally parallel to each other and to fold lines 120, 122, 124, and 126. In alternative embodiments, fold lines 202, 204, 206, and 208 may be other than substantially parallel to each other and/or to fold lines 120, 122, 124, and/or 126.

In the example embodiment, each reinforcing panel assembly 200 is substantially similar and includes an outer reinforcing panel 212 and an inner reinforcing panel 214. Outer reinforcing panel 212 is connected to inner reinforcing panel 214 along a fold line 216, which is substantially parallel to fold lines 202, 204, 206, and 208. More specifically, outer reinforcing panel 212 extends from a respective one of end panels 146 and 156 along one of fold lines 202, 204, 206, and 208, and inner reinforcing panel 214 extends from outer reinforcing panel 212 along fold line 216 to a free edge 218. In the example embodiment, each of outer reinforcing panels 212 and inner reinforcing panels 214 is substantially rectangular in shape. In alternative embodiments, each of outer reinforcing panels 212 and inner reinforcing panels 214 has any suitable shape that enables blank 100 to function as described herein.

In the example embodiment, bottom panel 114 has a depth 221. End panels 146 and 156 each have a depth 223 that is slightly shorter than depth 221 such that each of end panels 146 and 156 is narrower than bottom panel 114 by about twice a thickness of blank 100. Further, each of side panels 112 and 116 and rollover panels 110 and 118 have a width 225. Bottom panel 114 has a width 227 that is slightly longer than width 225. In other words, each of fold lines 202, 204, 206, and 208 is offset or spaced apart from a respective one of fold lines 122 and 124 by a distance equal to approximately twice the thickness of blank 100 to accommodate each outer reinforcing panel 212 and inner reinforcing panel 214 being coupled to exterior surface 104 of respective side panels 112 and 116 when container 300 is formed from blank 100. Moreover, free end edges 138, 140, 142, and 144 of side panels 112 and 116 and rollover panels 110 and 118 are offset or spaced apart from fold lines 148 and 158 sufficiently to accommodate each inner reinforcing panel 214 extending between the respective one of free end edges 138, 140, 142, and 144 and one of end panels 146 and 156 when container 300 is formed from blank 100. In alternative embodiments, each of bottom panel 114, end panels 146 and 156, side panels 112 and 116, and rollover panels 110 and 118 have any suitable depth and width that enables blank 100 to function as described herein.

In the example embodiment, outer reinforcing panels 212 have a width 229 and inner reinforcing panels 214 have a width 231 that is slightly less than width 229 such that when container 300 is formed from blank 100, each inner reinforcing panel 214 is aligned in an overlying relationship with at least a portion of each outer reinforcing panel 212. In alternative embodiments, each of outer reinforcing panels 212 and inner reinforcing panels 214 has any suitable width that enables blank 100 to function as described herein.

In the example embodiment, each outer reinforcing panel 212 has a height 233 that is less than height 129 by about the thickness of blank 100. Each inner reinforcing panel 214 has a height 235 that is substantially equal to height 233. At least a portion of an inner bottom edge 236 of each inner reinforcing panel 214 is positioned against interior surface 102 of bottom panel 114 when blank 100 is erected to form container 300. In alternative embodiments, each of outer reinforcing panels 212 and inner reinforcing panels 214 has any suitable height that enables blank 100 to function as described herein.

In the example embodiment, blank 100 is fabricated from a corrugated cardboard material and includes a plurality of corrugations or flutes (not shown) therein, oriented parallel to a corrugation direction indicated at 250. As described further herein, corrugation direction 250 facilitates improved strength of container 300.

In the example embodiment, a pair of cutouts 252 is defined substantially entirely within each of first side panel 112 and second side panel 116. Each cutout 252 is rectangular and sized slightly larger than top side flaps 170 such that top side flaps 170 align with side panels 112 and 116 when blank 100 is erected to form container 300. In alternative embodiments, blank 100 includes cutouts 252 in any suitable number and configuration that enables blank 100 and/or container 300 to function as described herein.

Turning more specifically to FIG. 2, container 300 includes a bottom wall 302, a pair of opposing side walls 304 and 306, a pair of opposing end walls 308 and 310, and a pair of top walls 312 and 314 that oppose bottom wall 302. In the example embodiment, each of the side walls 304 and 306 is generally perpendicular to each of end walls 308 and 310, each of the side walls 304 and 306 and end walls 308 and 310 is generally perpendicular to each of the top walls 312 and 314, and each of side walls 304 and 306 and end walls 308 and 310 is generally perpendicular to bottom wall 302, such that container 300 has a generally rectangular shape. In alternative embodiments, side walls 304 and 306, end walls 308 and 310, and bottom wall 302 have any relative orientation that enables container 300 to function as described herein. Side walls 304 and 306, end walls 308 and 310, and bottom wall 302 cooperate to define cavity 320 of container 300.

In the example embodiment, bottom wall 302 includes bottom panel 114. First end wall 308 includes first end panel 146, and second end wall 310 includes second end panel 156. First top wall 312 includes first top end flap 152 and second top wall 314 includes second top end flap 162. First side wall 304 includes first side panel 112, first rollover panel 110, reinforcing panel assembly 200 that extends from an edge defined along fold line 204 of first end panel 146, reinforcing panel assembly 200 that extends from an edge defined along fold line 208 of second end panel 156, top side flap 170 that extends from an edge defined along fold line 174 of top end flap 152, and top side flap 170 that extends from an edge defined along fold line 178 of top end flap 162. Accordingly, at least a portion of first side wall 304 has a thickness approximately equal to four times the thickness of blank 100. Second side wall 306 includes second side panel 116, second rollover panel 118, reinforcing panel assembly 200 that extends from an edge defined along fold line 202 of first end panel 146, reinforcing panel assembly 200 that extends from an edge defined along fold line 206 of second end panel 156, top side flap 170 that extends from an edge defined along fold line 172 of top end flap 152, and top side flap 170 that extends from an edge defined along fold line 176 of top end flap 162. Accordingly, at least a portion of second side wall 306 has a thickness approximately equal to four times the thickness of blank 100. More specifically, exterior surface 104 of each outer reinforcing panel 212 of each reinforcing panel assembly 200 is in a substantially face-to-face relationship with exterior surface 104 of the corresponding one of rollover panels 110 and 118.

Due to the corrugation direction 250 of flutes within blank 100, reinforcing panel assemblies 200 have vertically oriented flutes when container 300 is formed from blank 100, thereby increasing a stacking strength of reinforcing structures 321. By providing rollover panels 110 and 118 and reinforcing panel assemblies 200, the example embodiment of container 300 provides increased stacking strength in comparison to containers without rollover panels 110 and 118 and reinforcing panel assemblies 200.

More specifically, interior surface 102 of each outer reinforcing panel 212 is positioned in a substantially face-to-face relationship with interior surface 102 of inner reinforcing panel 214, and exterior surface 104 of each inner reinforcing panel 214 is coupled to exterior surface 104 of the corresponding one of rollover panels 110 and 118. In the example embodiment, interior surface 102 of first rollover panel 110 is positioned in a substantially face-to-face relationship with interior surface 102 of first side panel 112, and interior surface 102 of second rollover panel 118 is positioned in a substantially face-to-face relationship with interior surface 102 of second side panel 116. Further in the example embodiment, interior surface 102 each top side flap 170 is positioned in a substantially face-to-face relationship with interior surface 102 of first rollover panel 110 or second rollover panel 118 via cutouts 252.

Thus, in the example embodiment, at least a reinforced portion 322 of each of side walls 304 and 306, adjacent each respective end wall 308 and 310, has a thickness defined by the respective one of rollover panels 110 and 118, the respective one of side panels 112 and 116, and the respective reinforcing structure 321 (i.e., the respective inner reinforcing panel 214 and the respective outer reinforcing panel 212), each extending from a bottom edge 330 to a top edge 332 of the respective side wall 304 or 306.

In the example embodiment, bottom panel 114 is sized to correspond to product(s) contained within container 300. Although container 300 is shown as being formed without a product to be contained therein, container 300 may also be formed around a product contained therein. Further, container 300 may include any suitable number of products of any suitable shape.

To form container 300 from blank 100, each rollover panel 110 and 118 is rotated toward interior surface 102 of each side panel 112 and 116, respectively, about fold lines 120 and 126, respectively, such that rollover panels 110 and 118 are aligned in a substantially face-to-face relationship with side panels 112 and 116. Each side panel 112 and 116 is rotated about fold lines 122 and 124, respectively, into a substantially perpendicular relationship with bottom panel 114. Each inner reinforcing panel 214 is rotated about fold line 216 toward interior surface 102 of outer reinforcing panel 212, such that outer reinforcing panel 212 and inner reinforcing panel 214 are aligned in a substantially face-to-face relationship. Each pair of aligned outer reinforcing panels 212 and inner reinforcing panels 214 is rotated about at least one of fold line 216 and one of fold lines 202, 204, 206, and 208 toward interior surface 102 of the respective one of end panels 146 and 156 into a substantially perpendicular relationship with the respective one of end panels 146 and 156.

In the example embodiment, at least one of inner reinforcing panel 214, outer reinforcing panel 212, and the respective end panel 146 or 156 are secured in the above-described relationships. Any of the panels may be attached using, for example, adhesive, another suitable bonding material, fasteners, and/or any other suitable method for attaching panels. Additionally or alternatively, at least one of inner reinforcing panel 214, outer reinforcing panel 212, and the respective end panel 146 or 156 is maintained in the above-described relationships by a force applied by a machine and/or by hand.

First and second end panels 146 and 156 are rotated inwardly about fold lines 148 and 158, respectively, into a substantially perpendicular relationship with bottom panel 114. Each inner reinforcing panel 214 and a portion of a respective one of rollover panels 110 and 118 are aligned in a substantially face-to-face relationship. Each inner reinforcing panel 214 is attached to the respective one of rollover panels 110 and 118 to form a container 300. For example, an adhesive is applied to at least one of exterior surface 104 of inner reinforcing panel 214 and the respective exterior surface 104 of one of rollover panels 110 and 118. Alternatively or additionally, inner reinforcement panel 214 is attached to the respective one of rollover panels 110 and 118 using, for example, fasteners, another suitable bonding material, and/or any other suitable method for attaching panels.

Further in the example embodiment, each top end flap 152 and 162 is rotated inwardly about fold lines 150 and 160, respectively, into a substantially perpendicular relationship with the edge of the respective reinforcing panel assembly 200. Moreover, each of top side flaps 170 are rotated downwardly about respective fold lines 172, 174, 176, and 178 into a substantially face-to-face relationship with the respective one of rollover panels 110 and 118 through cutout 252. In the example embodiment, each top side flap 170 is attached to the respective one of rollover panels 110 and 118 using, for example, an adhesive, another suitable bonding material, fasteners, and/or any other suitable method for attaching panels. By rotating each top side flap 170 into cutout 252, the outer surface of container 300 is substantially planar which provides an improved printing surface and reduces the number of possible "catch points" on the outside of container 300.

Turning more specifically to FIG. 3, blank 500 has a first or interior surface 502 and an opposing second or exterior surface 504. Further, blank 500 defines a leading edge 506 and an opposing trailing edge 508. In one embodiment, blank 500 includes, in series from leading edge 506 to trailing edge 508, a plurality of side panels (at least one of which may be referred to as "end panels"), including, specifically, a first rollover panel 510 (or first inner side panel), a first side panel 512 (or first outer side panel), a bottom panel 514, a second side panel 516 (or second outer side panel), and a second rollover panel 518 (or second inner side panel) coupled together along preformed, generally parallel, fold lines 520, 522, 524, and 526 respectively. More specifically, first rollover panel 510 extends between leading edge 506 and fold line 520, first side panel 512 extends from fold line 520, bottom panel 514 extends from fold line 522, second side panel 516 extends from fold line 524, and second rollover panel 518 extends between fold line 526 and trailing edge 508. Fold line 520 defines a top edge of first rollover panel 510 and a top edge of first side panel 512 when the container is formed. Fold line 522 defines a bottom edge of first side panel 512 and a first side edge of bottom panel 514. Fold line 524 defines a bottom edge of second side panel 516 and a second side edge of bottom panel 514. Fold line 526 defines a top edge of second rollover panel 518 and a top edge of second side panel 516. Fold lines 520, 522, 524, and 526 as well as other fold lines and/or hinge lines described herein, may include any suitable line of weakening and/or line of separation known to those skilled in the art and guided by the teachings herein provided.

In the example embodiment, first rollover panel 510 and first side panel 512 are substantially congruent and have a rectangular shape, second rollover panel 518 and second side panel 516 are substantially congruent and have a rectangular shape, and bottom panel 514 has a substantially rectangular shape. Moreover, rollover panels 510 and 518 each have a height 527, and side panels 512 and 516 each have a height 529 that is slightly greater than height 527 by approximately a thickness of blank 500, to accommodate rollover panels 510 and 518 being positioned in an overlying relationship with side panels 512 and 516, respectively, when container 700 (shown in FIG. 4) is formed from blank 500. In alternative embodiments, first rollover panel 510 and first side panel 512 are other than substantially congruent, and/or second rollover panel 518 and second side panel 516 are other than substantially congruent. Moreover, in alternative embodiments, each of rollover panels 510 and 518 and side panels 512 and 516 have any suitable height that enables blank 500 to function as described herein.

In the example embodiment, first rollover panel 510 includes two free end edges 530 and 532, and second rollover panel 518 includes two free end edges 534 and 536. First side panel 512 includes two free end edges 538 and 540, and second side panel 516 includes two free end edges 542 and 544. Free end edges 530, 532, 534, 536, 538, 540, 542, and 544 are generally parallel to each other. In alternative embodiments, free end edges 530, 532, 534, 536, 538, 540, 542, and 544 may be other than substantially parallel to each other.

A first end panel 546 extends from bottom panel 514 along a fold line 548 to a fold line 550, and a first top end flap 552 extends from fold line 550 to a free edge 554. A second end panel 556 extends from bottom panel 514 along a fold line 558 to a fold line 560, and a second top end flap 562 extends from fold line 560 to a free edge 564. Fold line 548 defines a bottom edge of first end panel 546 and a first end edge of bottom panel 514. Fold line 550 defines a top edge of first end panel 546. Fold line 558 defines a bottom edge of second end panel 556 and a second end edge of bottom panel 514. Fold line 560 defines a top edge of second end panel 556. In the example embodiment, first and second end panels 546 and 556 each have a generally rectangular shape, and each have a height 563 that is approximately equal to height 529. In the example embodiment, first and second top end flaps 552 and 562 each have a generally rectangular shape, and each have a width 565 that is less than height 563. In alternative embodiments, each of end panels 546 and 556 and each of top end flaps 552 and 562 have any suitable shape and height that enables blank 500 to function as described herein.

A top side flap assembly 570 extends from each opposing end edge of each of top end flaps 552 and 562. Top side flap assembly 570 includes a plurality of panels as will be described herein. Each side edge of top end flaps 552 and 562 is defined by a respective one of fold lines 572, 574, 576, and 578. In the example embodiment, fold lines 572, 574, 576, and 578 are generally parallel to each other and to fold lines 520, 522, 524, and 526. In alternative embodiments, fold lines 572, 574, 576, and 578 may be other than substantially parallel to each other and/or to fold lines 520, 522, 524, and/or 526. Together, each of top end flaps 552 and 562 and the respective top side flap assemblies 570 define upper reinforcing assemblies. In other words, one upper reinforcing assembly includes top end flap 552 and top side flap assemblies 170 extending along fold lines 572 and 574, and another upper reinforcing assembly includes top end flap 562 and top side flap assemblies 170 extending along fold lines 576 and 578.

In the example embodiment, each top side flap assembly 570 is substantially similar and includes an outer flap 580 and an inner flap 582. Outer flap 580 is connected to inner flap 582 along a fold line 584, which is substantially parallel to fold lines 572, 574, 576, and 578. More specifically, outer flap 580 extends from a respective one of top end flaps 552 and 562 along one of fold lines 572, 574, 576, and 578, and inner flap 582 extends from outer flap 580 along fold line 584 to a free edge 586. In the example embodiment, each of outer flaps 580 and inner flaps 582 is substantially rectangular in shape. In alternative embodiments, each of outer flaps 580 and inner flaps 582 has any suitable shape that enables blank 500 to function as described herein.

A reinforcing panel assembly 600 (or side reinforcing assembly) extends from each opposing end edge of each end panel 546 and 556. Reinforcing panel assembly 600 includes a plurality of panels as will be described herein. Each side edge of end panels 546 and 556 is defined by a respective one of fold lines 602, 604, 606, and 608. In the example embodiment, fold lines 602, 604, 606, and 608 are generally parallel to each other and to fold lines 520, 522, 524, and 526. In alternative embodiments, fold lines 602, 604, 606, and 608 may be other than substantially parallel to each other and/or to fold lines 520, 522, 524, and/or 526.

In the example embodiment, each reinforcing panel assembly 600 is substantially similar and includes an outer reinforcing panel 612 and an inner reinforcing panel 614. Outer reinforcing panel 612 is connected to inner reinforcing panel 614 along a fold line 616, which is substantially parallel to fold lines 602, 604, 606, and 608. More specifically, outer reinforcing panel 612 extends from a respective one of end panels 546 and 556 along one of fold lines 602, 604, 606, and 608, and inner reinforcing panel 614 extends from outer reinforcing panel 612 along fold line 616 to a free edge 618. In the example embodiment, each of outer reinforcing panels 612 and inner reinforcing panels 614 is substantially rectangular in shape. In alternative embodiments, each of outer reinforcing panels 612 and inner reinforcing panels 614 has any suitable shape that enables blank 500 to function as described herein.

In the example embodiment, bottom panel 514 and top end flaps 552 and 562 have a depth 621. End panels 546 and 556 each have a depth 623 that is slightly shorter than depth 621 such that each of end panels 546 and 556 is narrower than bottom panel 514 by about twice a thickness of blank 500. Further, each of side panels 512 and 516 and rollover panels 510 and 518 have a width 625. Bottom panel 514 has a width 627 that is slightly longer than width 625. In other words, each of fold lines 602, 604, 606, and 608 is offset or spaced apart from a respective one of fold lines 522 and 524 by a distance equal to approximately twice the thickness of blank 500 to accommodate each outer reinforcing panel 612 and inner reinforcing panel 614 being coupled to exterior surface 504 of respective side panels 512 and 516 when container 700 is formed from blank 500. Moreover, free end edges 538, 540, 542, and 544 of side panels 512 and 516 and rollover panels 510 and 518 are offset or spaced apart from fold lines 548 and 558 sufficiently to accommodate each inner reinforcing panel 614 extending between the respective one of free end edges 538, 540, 542, and 544 and one of end panels 546 and 556 when container 700 is formed from blank 500. In alternative embodiments, each of bottom panel 514, top end flaps 552 and 562, end panels 546 and 556, side panels 512 and 516, and rollover panels 510 and 518 have any suitable depth and width that enables blank 500 to function as described herein.

In the example embodiment, outer reinforcing panels 612 have a width 629 and inner reinforcing panels 614 have a width 631 that is slightly less than width 629 such that when container 700 is formed from blank 500, each inner reinforcing panel 614 is aligned in an overlying relationship with at least a portion of each outer reinforcing panel 612. In alternative embodiments, each of outer reinforcing panels 612 and inner reinforcing panels 614 has any suitable width that enables blank 500 to function as described herein.

In the example embodiment, each outer reinforcing panel 612 has a height 633 that is less than height 529 by about the thickness of blank 500. Each inner reinforcing panel 614 has a height 635 that is substantially equal to height 633. At least a portion of an inner bottom edge 636 of each inner reinforcing panel 614 is positioned against interior surface 502 of bottom panel 514 when blank 500 is erected to form container 700. In alternative embodiments, each of outer reinforcing panels 612 and inner reinforcing panels 614 has any suitable height that enables blank 500 to function as described herein.

In the example embodiment, each outer flap 580 and each inner flap 582 of top side flap assembly 570 has a width 637 that is slightly larger than width 565 by about the thickness of blank 500. Each outer flap 580 has a height 639 that is slightly larger than height 641 of inner flap 582, such that when container 700 is formed from blank 500, each inner flap 582 is aligned in an overlying relationship with at least a portion of each outer flap 580. In alternative embodiments, each of outer flap 580 and inner flap 582 has any suitable width and height that enables blank 500 to function as described herein.

In the example embodiment, blank 500 is fabricated from a corrugated cardboard material and includes a plurality of corrugations or flutes (not shown) therein, oriented parallel to a corrugation direction indicated at 650. As described further herein, corrugation direction 650 facilitates improved strength of container 700.

Turning more specifically to FIG. 4, container 700 includes a bottom wall 702, a pair of opposing side walls 704 and 706, a pair of opposing end walls 708 and 710, and a pair of top walls 712 and 714 that oppose bottom wall 702. In the example embodiment, each of the side walls 704 and 706 is generally perpendicular to each of end walls 708 and 710, each of the side walls 704 and 706 and end walls 708 and 710 is generally perpendicular to each of the top walls 712 and 714, and each of side walls 704 and 706 and end walls 708 and 710 is generally perpendicular to bottom wall 702, such that container 700 has a generally rectangular shape. In alternative embodiments, side walls 704 and 706, end walls 708 and 710, and bottom wall 702 have any relative orientation that enables container 700 to function as described herein. Side walls 704 and 706, end walls 708 and 710, and bottom wall 702 cooperate to define cavity 720 of container 700.

In the example embodiment, bottom wall 702 includes bottom panel 514. First end wall 708 includes first end panel 546, and second end wall 710 includes second end panel 556. First top wall 712 includes first top end flap 552 and second top wall 714 includes second top end flap 562. First side wall 704 includes first side panel 512, first rollover panel 510, reinforcing panel assembly 600 that extends from an edge defined along fold line 604 of first end panel 546, reinforcing panel assembly 600 that extends from an edge defined along fold line 608 of second end panel 556, top side flap assembly 570 that extends from an edge defined along fold line 574 of top end flap 552, and top side flap assembly 570 that extends from an edge defined along fold line 578 of top end flap 562. Accordingly, at least a portion of first side wall 704 has a thickness approximately equal to four times the thickness of blank 500. Second side wall 706 includes second side panel 516, second rollover panel 518, reinforcing panel assembly 600 that extends from an edge defined along fold line 602 of first end panel 546, reinforcing panel assembly 600 that extends from an edge defined along fold line 606 of second end panel 556, top side flap assembly 570 that extends from an edge defined along fold line 572 of top end flap 552, and top side flap assembly 570 that extends from an edge defined along fold line 576 of top end flap 562. Accordingly, at least a portion of second side wall 706 has a thickness approximately equal to four times the thickness of blank 500. More specifically, exterior surface 504 of each outer reinforcing panel 612 of each reinforcing panel assembly 600 is in a substantially face-to-face relationship with exterior surface 504 of the corresponding one of rollover panels 510 and 518.

Due to the corrugation direction 650 of flutes within blank 500, reinforcing panel assemblies 600 have vertically oriented flutes when container 700 is formed from blank 500, thereby increasing a stacking strength of reinforcing structures 721. By providing rollover panels 510 and 518 and reinforcing panel assemblies 600, the example embodiment of container 700 provides increased stacking strength in comparison to containers without rollover panels 510 and 518 and reinforcing panel assemblies 600.

More specifically, interior surface 502 of each outer reinforcing panel 612 is positioned in a substantially face-to-face relationship with interior surface 502 of inner reinforcing panel 614, and exterior surface 504 of each inner reinforcing panel 614 is coupled to exterior surface 504 of the corresponding one of rollover panels 510 and 518. In the example embodiment, interior surface 502 of first rollover panel 510 is positioned in a substantially face-to-face relationship with interior surface 502 of first side panel 512, and interior surface 502 of second rollover panel 518 is positioned in a substantially face-to-face relationship with interior surface 502 of second side panel 516. Further in the example embodiment, interior surface 502 of each outer flap 580 is positioned in a substantially face-to-face relationship with interior surface 502 of each inner flap 582, and exterior surface 504 of each of inner flap 580 is coupled to exterior surface 504 of the corresponding outer reinforcing panel 612.

Thus, in the example embodiment, at least a reinforced portion 722 of each of side walls 704 and 706, adjacent each respective end wall 708 and 710, has a thickness defined by the respective one of rollover panels 510 and 518, the respective one of side panels 512 and 516, and the respective reinforcing structure 721 (i.e., the respective inner reinforcing panel 614 and the respective outer reinforcing panel 612), each extending from a bottom edge 730 to a top edge 732 of the respective side wall 704 or 706.

In the example embodiment, bottom panel 514 is sized to correspond to product(s) contained within container 700. Although container 700 is shown as being formed without a product to be contained therein, container 700 may also be formed around a product contained therein. Further, container 700 may include any suitable number of products of any suitable shape.

To form container 700 from blank 500, each rollover panel 510 and 518 is rotated toward interior surface 502 of each side panel 512 and 516, respectively, about fold lines 520 and 526, respectively, such that rollover panels 510 and 518 are aligned in a substantially face-to-face relationship with side panels 512 and 516. Each side panel 512 and 516 is rotated about fold lines 522 and 524, respectively, into a substantially perpendicular relationship with bottom panel 514. Each inner reinforcing panel 614 is rotated about fold line 616 toward interior surface 502 of outer reinforcing panel 612, such that outer reinforcing panel 612 and inner reinforcing panel 614 are aligned in a substantially face-to-face relationship. Each pair of aligned outer reinforcing panels 612 and inner reinforcing panels 614 is rotated about at least one of fold line 616 and one of fold lines 602, 604, 606, and 608 toward interior surface 502 of the respective one of end panels 546 and 556 into a substantially perpendicular relationship with the respective one of end panels 546 and 556.

In the example embodiment, at least one of inner reinforcing panel 614, outer reinforcing panel 612, and the respective end panel 546 or 556 are secured in the above-described relationships. Any of the panels may be attached using, for example, adhesive, another suitable bonding material, fasteners, and/or any other suitable method for attaching panels. Additionally or alternatively, at least one of inner reinforcing panel 614, outer reinforcing panel 612, and the respective end panel 546 or 556 is maintained in the above-described relationships by a force applied by a machine and/or by hand.

First and second end panels 546 and 556 are rotated inwardly about fold lines 548 and 558, respectively, into a substantially perpendicular relationship with bottom panel 514. Each inner reinforcing panel 614 and a portion of a respective one of rollover panels 510 and 518 are aligned in a substantially face-to-face relationship. Each inner reinforcing panel 614 is attached to the respective one of rollover panels 510 and 518 to form a container 700. For example, an adhesive is applied to at least one of exterior surface 504 of inner reinforcing panel 614 and the respective exterior surface 504 of one of rollover panels 510 and 518. Alternatively or additionally, inner reinforcement panel 614 is attached to the respective one of rollover panels 510 and 518 using, for example, fasteners, another suitable bonding material, and/or any other suitable method for attaching panels.

Further in the example embodiment, each inner flap 582 is rotated about fold line 584 toward interior surface 502 of outer flap 580 such that outer flap 580 and inner flap 582 are aligned in a substantially face-to-face relationship. Each pair of aligned outer flaps 580 and inner flaps 582 is rotated about at least one of fold line 584 and one of fold lines 572, 574, 576, and 578 toward exterior surface 504 of the respective one of outer reinforcement panels 612 such that exterior surface 504 of inner flap 582 is aligned in a substantially face-to-face relationship with exterior surface 504 of outer reinforcing panel 612. In the example embodiment, each top side flap assembly 570 is attached to the respective one of reinforcing panel assemblies 600 using, for example, an adhesive, another suitable bonding material, fasteners, and/or any other suitable method for attaching panels.

Turning to FIG. 5, blank 1100 has a first or interior surface 1102 and an opposing second or exterior surface 1104. Further, blank 1100 defines a leading edge 1106 and an opposing trailing edge 1108. In one embodiment, blank 1100 includes, in series from leading edge 1106 to trailing edge 1108, a plurality of side panels (at least one of which may be referred to as "end panels"), including, specifically, a first rollover panel 1110 (or first inner side panel), a first side panel 1112 (or first outer side panel), a bottom panel 1114, a second side panel 1116 (or second outer side panel), and a second rollover panel 1118 (or second inner side panel) coupled together along preformed, generally parallel, fold lines 1120, 1122, 1124, and 1126 respectively. More specifically, first rollover panel 1110 extends between leading edge 1106 and fold line 1120, first side panel 1112 extends from fold line 1120, bottom panel 1114 extends from fold line 1122, second side panel 1116 extends from fold line 1124, and second rollover panel 1118 extends between fold line 1126 and trailing edge 1108. Fold line 1120 defines a top edge of first rollover panel 1110 and a top edge of first side panel 1112 when the container is formed. Fold line 1122 defines a bottom edge of first side panel 1112 and a first side edge of bottom panel 1114. Fold line 1124 defines a bottom edge of second side panel 1116 and a second side edge of bottom panel 1114. Fold line 1126 defines a top edge of second rollover panel 1118 and a top edge of second side panel 1116. Fold lines 1120, 1122, 1124, and 1126 as well as other fold lines and/or hinge lines described herein, may include any suitable line of weakening and/or line of separation known to those skilled in the art and guided by the teachings herein provided.

In the example embodiment, first rollover panel 1110 and first side panel 1112 are substantially congruent and have a rectangular shape, second rollover panel 1118 and second side panel 1116 are substantially congruent and have a rectangular shape, and bottom panel 1114 has a substantially rectangular shape. Moreover, rollover panels 1110 and 1118 each have a height 1127, and side panels 1112 and 1116 each have a height 1129 that is slightly greater than height 1127 by approximately a thickness of blank 1100, to accommodate rollover panels 1110 and 1118 being positioned in an overlying relationship with side panels 1112 and 1116, respectively, when container 1300 (shown in FIG. 6) is formed from blank 1100. In alternative embodiments, first rollover panel 1110 and first side panel 1112 are other than substantially congruent, and/or second rollover panel 1118 and second side panel 1116 are other than substantially congruent. Moreover, in alternative embodiments, each of rollover panels 1110 and 1118 and side panels 1112 and 1116 have any suitable height that enables blank 1100 to function as described herein.

In the example embodiment, first rollover panel 1110 includes two free end edges 1130 and 1132, and second rollover panel 1118 includes two free end edges 1134 and 1136. First side panel 1112 includes two free end edges 1138 and 1140, and second side panel 1116 includes two free end edges 1142 and 1144. Free end edges 1130, 1132, 1134, 1136, 1138, 1140, 1142, and 1144 are generally parallel to each other. In alternative embodiments, free end edges 1130, 1132, 1134, 1136, 1138, 1140, 1142, and 1144 may be other than substantially parallel to each other.

A first end panel 1146 extends from bottom panel 1114 along a fold line 1148 to a fold line 1150, and a first top end flap 1152 extends from fold line 1150 to a free edge 1154. A second end panel 1156 extends from bottom panel 1114 along a fold line 1158 to a fold line 1160, and a second top end flap 1162 extends from fold line 1160 to a free edge 1164. Fold line 1148 defines a bottom edge of first end panel 1146 and a first end edge of bottom panel 1114. Fold line 1150 defines a top edge of first end panel 1146. Fold line 1158 defines a bottom edge of second end panel 1156 and a second end edge of bottom panel 1114. Fold line 1160 defines a top edge of second end panel 1156. In the example embodiment, first and second end panels 1146 and 1156 each have a generally rectangular shape, and each have a height 1163 that is approximately equal to height 1129. In the example embodiment, first and second top end flaps 1152 and 1162 each have a generally rectangular shape, and each have a width 1165 that is smaller than height 1163. In alternative embodiments, each of end panels 1146 and 1156 and each of top end flaps 1152 and 1162 have any suitable shape and height that enables blank 1100 to function as described herein.

A top side flap assembly 1170 extends from each opposing end edge of each of top end flaps 1152 and 1162. Top side flap assembly 1170 includes a plurality of panels as will be described herein. Each side edge of top end flaps 1152 and 1162 is defined by a respective one of fold lines 1172, 1174, 1176, and 1178. In the example embodiment, fold lines 1172, 1174, 1176, and 1178 are generally parallel to each other and to fold lines 1120, 1122, 1124, and 1126. In alternative embodiments, fold lines 1172, 1174, 1176, and 1178 may be other than substantially parallel to each other and/or to fold lines 1120, 1122, 1124, and/or 1126. Together, each of top end flaps 1152 and 1162 and the respective top side flap assemblies 1170 define upper reinforcing assemblies. In other words, one upper reinforcing assembly includes top end flap 1152 and top side flap assemblies 1170 extending along fold lines 1172 and 1174, and another upper reinforcing assembly includes top end flap 1162 and top side flap assemblies 1170 extending along fold lines 1176 and 1178.

In the example embodiment, each top side flap assembly 1170 is substantially similar and includes an outer flap 1180 and an inner flap 1182. Outer flap 1180 is connected to inner flap 1182 along a fold line 1184, which is substantially parallel to fold lines 1172, 1174, 1176, and 1178. More specifically, outer flap 1180 extends from a respective one of top end flaps 1152 and 1162 along one of fold lines 1172, 1174, 1176, and 1178, and inner flap 1182 extends from outer flap 1180 along fold line 1184 to a free edge 1186. In the example embodiment, each of outer flaps 1180 and inner flaps 1182 is substantially rectangular in shape. In alternative embodiments, each of outer flaps 1180 and inner flaps 1182 has any suitable shape that enables blank 1100 to function as described herein.

A reinforcing panel 1200 (or side reinforcing assembly) extends from each opposing side edge of each end panel 1146 and 1156. Each side edge of end panels 1146 and 1156 is defined by a respective one of fold lines 1202, 1204, 1206, and 1208. In the example embodiment, fold lines 1202, 1204, 1206, and 1208 are generally parallel to each other and to fold lines 1120, 1122, 1124, and 1126. In alternative embodiments, fold lines 1202, 1204, 1206, and 1208 may be other than substantially parallel to each other and/or to fold lines 1120, 1122, 1124, and/or 1126.

In the example embodiment, each reinforcing panel 1200 is substantially similar and extends from a respective one of end panels 1146 and 1156 along one of fold lines 1202, 1204, 1206, and 1208 to free end 1210. In the example embodiment, each reinforcing panel 1200 is substantially rectangular in shape, except for a notch 1212, which is cut out from one corner along free end 1210. In alternative embodiments, reinforcing panels 1200 have any suitable shape that enables blank 1100 to function as described herein.

In the example embodiment, bottom panel 1114 and end flaps 152 and 162 have a depth 1221. End panels 1146 and 1156 each have a depth 1223 that is slightly shorter than depth 1221 such that each of end panels 1146 and 1156 is narrower than bottom panel 1114 by about twice a thickness of blank 1100. Further, each of side panels 1112 and 1116 and rollover panels 1110 and 1118 have a width 1225. Bottom panel 1114 has a width 1227 that is slightly longer than width 1225. In other words, each of fold lines 1202, 1204, 1206, and 1208 is offset or spaced apart from a respective one of fold lines 1122 and 1124 by a distance equal to approximately twice the thickness of blank 1100 to accommodate each reinforcing panel 1200 being coupled to exterior surface 1104 of respective side panels 1112 and 1116 when container 1300 is formed from blank 1100. Moreover, free end edges 1138, 1140, 1142, and 1144 of side panels 1112 and 1116 and rollover panels 1110 and 1118 are offset or spaced apart from fold lines 1148 and 1158 sufficiently to accommodate each reinforcing panel 1200 extending between the respective one of free end edges 1138, 1140, 1142, and 1144 and one of end panels 1146 and 1156 when container 1300 is formed from blank 1100. In alternative embodiments, each of bottom panel 1114, end panels 1146 and 1156, side panels 1112 and 1116, and rollover panels 1110 and 1118 have any suitable depth and width that enables blank 1100 to function as described herein.

In the example embodiment, reinforcing panels 1200 have a width 1229 such that when container 1300 is formed from blank 1100, each reinforcing panel 1200 is aligned in an overlying relationship with at least a portion of respective rollover panels 1110 and 1118. In alternative embodiments, each of reinforcing panel 1200 has any suitable width that enables blank 1100 to function as described herein. In the example embodiment, each reinforcing panel 1200 has a height 1233 that is less than height 1129 by about the thickness of blank 1100. At least a portion of an inner bottom edge 1236 of each reinforcing panel 1200 is positioned against interior surface 1102 of bottom panel 1114 when blank 1100 is erected to form container 1300. In alternative embodiments, each reinforcing panel 1200 has any suitable height that enables blank 1100 to function as described herein.

In the example embodiment, each outer flap 1180 and each inner flap 1182 of top side flap assembly 1170 has a width 1237 that is slightly larger than width 1165 by about the thickness of blank 500. Each outer flap 1180 has a height 1239 that is slightly larger than height 1241 of inner flap 1182, such that when container 1300 is formed from blank 1100, each inner flap 1182 is aligned in an overlying relationship with at least a portion of each outer flap 1180. In alternative embodiments, each of outer flap 1180 and inner flap 1182 has any suitable width and height that enables blank 1100 to function as described herein.

In the example embodiment, blank 1100 is fabricated from a corrugated cardboard material and includes a plurality of corrugations or flutes (not shown) therein, oriented parallel to a corrugation direction indicated at 1250. As described further herein, corrugation direction 1250 facilitates improved strength of container 1300.

Turning more specifically to FIG. 5, container 1300 includes a bottom wall 1302, a pair of opposing side walls 1304 and 1306, a pair of opposing end walls 1308 and 1310, and a pair of top walls 1312 and 1314 that oppose bottom wall 1302. In the example embodiment, each of the side walls 1304 and 1306 is generally perpendicular to each of end walls 1308 and 1310, each of the side walls 1304 and 1306 and end walls 1308 and 1310 is generally perpendicular to each of the top walls 1312 and 1314, and each of side walls 1304 and 1306 and end walls 1308 and 1310 is generally perpendicular to bottom wall 1302, such that container 1300 has a generally rectangular shape. In alternative embodiments, side walls 1304 and 1306, end walls 1308 and 1310, and bottom wall 1302 have any relative orientation that enables container 1300 to function as described herein. Side walls 1304 and 1306, end walls 1308 and 1310, and bottom wall 1302 cooperate to define cavity 1320 of container 1300.

In the example embodiment, bottom wall 1302 includes bottom panel 1114. First end wall 1308 includes first end panel 1146, and second end wall 1310 includes second end panel 1156. First top wall 1312 includes first top end flap 1152 and second top wall 1314 includes second top end flap 1162. First side wall 1304 includes first side panel 1112, first rollover panel 1110, reinforcing panel 1200 that extends from an edge defined along fold line 1204 of first end panel 1146, reinforcing panel 1200 that extends from an edge defined along fold line 1208 of second end panel 1156, top side flap assembly 1170 that extends from an edge defined along fold line 1174 of top end flap 1152, and top side flap assembly 1170 that extends from an edge defined along fold line 1178 of top end flap 1162. Accordingly, at least a portion of first side wall 1304 has a thickness approximately equal to three times the thickness of blank 1100. Second side wall 1306 includes second side panel 1116, second rollover panel 1118, reinforcing panel 1200 that extends from an edge defined along fold line 1202 of first end panel 1146, reinforcing panel assembly 1200 that extends from an edge defined along fold line 1206 of second end panel 1156, top side flap assembly 1170 that extends from an edge defined along fold line 1172 of top end flap 1152, and top side flap assembly 1170 that extends from an edge defined along fold line 1176 of top end flap 1162. Accordingly, at least a portion of second side wall 1306 has a thickness approximately equal to three times the thickness of blank 1100. More specifically, exterior surface 1104 reinforcing panel 1200 is in a substantially face-to-face relationship with exterior surface 1104 of the corresponding one of rollover panels 1110 and 1118.

Due to the corrugation direction 1250 of flutes within blank 1100, reinforcing panels 1200 have vertically oriented flutes when container 1300 is formed from blank 1100, thereby increasing a stacking strength of reinforcing structures 1321. By providing rollover panels 1110 and 1118 and reinforcing panels 1200, the example embodiment of container 1300 provides increased stacking strength in comparison to containers without rollover panels 1110 and 1118 and reinforcing panels 1200.

More specifically, exterior surface 1104 of each reinforcing panel 1200 is coupled to exterior surface 1104 of the corresponding one of rollover panels 1110 and 1118. In the example embodiment, interior surface 1102 of first rollover panel 1110 is positioned in a substantially face-to-face relationship with interior surface 1102 of first side panel 1112, and interior surface 1102 of second rollover panel 1118 is positioned in a substantially face-to-face relationship with interior surface 1102 of second side panel 1116. Further in the example embodiment, interior surface 1102 of each outer flap 1180 is positioned in a substantially face-to-face relationship with interior surface 1102 of each inner flap 1182, and exterior surface 1104 of each of inner flap 1180 is coupled to exterior surface 1104 of the corresponding reinforcing panel 1200.

Thus, in the example embodiment, at least a reinforced portion 1322 of each of side walls 1304 and 1306, adjacent each respective end wall 1308 and 1310, has a thickness defined by the respective one of rollover panels 1110 and 1118, the respective one of side panels 1112 and 1116, and the respective reinforcing structure 1321 (i.e., the respective reinforcing panel 1200), each extending from a bottom edge 1330 to a top edge 1332 of the respective side wall 1304 or 1306.

In the example embodiment, bottom panel 1114 is sized to correspond to product(s) contained within container 1300. Although container 1300 is shown as being formed without a product to be contained therein, container 1300 may also be formed around a product contained therein. Further, container 1300 may include any suitable number of products of any suitable shape.

To form container 1300 from blank 1100, each rollover panel 1110 and 1118 is rotated toward interior surface 1102 of each side panel 1112 and 1116, respectively, about fold lines 1120 and 1126, respectively, such that rollover panels 1110 and 1118 are aligned in a substantially face-to-face relationship with side panels 1112 and 1116. Each side panel 1112 and 1116 is rotated about fold lines 1122 and 1124, respectively, into a substantially perpendicular relationship with bottom panel 1114. Each reinforcing panel 1200 is rotated about at least one of fold lines 1202, 1204, 1206, and 1208 toward interior surface 1102 of the respective one of end panels 1146 and 1156 into a substantially perpendicular relationship with the respective one of end panels 1146 and 1156.

In the example embodiment, at least one of reinforcing panel 1200 and the respective end panel 1146 or 1156 are secured in the above-described relationships. Any of the panels may be attached using, for example, adhesive, another suitable bonding material, fasteners, and/or any other suitable method for attaching panels. Additionally or alternatively, at least one of reinforcing panel 1200 and the respective end panel 1146 or 1156 is maintained in the above-described relationships by a force applied by a machine and/or by hand.

First and second end panels 1146 and 1156 are rotated inwardly about fold lines 1148 and 1158, respectively, into a substantially perpendicular relationship with bottom panel 1114. Each reinforcing panel 1200 and a portion of a respective one of rollover panels 1110 and 1118 are aligned in a substantially face-to-face relationship. Each reinforcing panel 1200 is attached to the respective one of rollover panels 1110 and 1118 to form a container 1300. For example, an adhesive is applied to at least one of exterior surface 1104 of reinforcing panel 1200 and the respective exterior surface 1104 of one of rollover panels 1110 and 1118. Alternatively or additionally, reinforcement panel 1200 is attached to the respective one of rollover panels 1110 and 1118 using, for example, fasteners, another suitable bonding material, and/or any other suitable method for attaching panels.

Further in the example embodiment, each inner flap 1182 is rotated about fold line 1184 toward interior surface 1102 of outer flap 1180 such that outer flap 1180 and inner flap 1182 are aligned in a substantially face-to-face relationship. Each pair of aligned outer flaps 1180 and inner flaps 1182 is rotated about at least one of fold line 1184 and one of fold lines 1172, 1174, 1176, and 1178 toward exterior surface 1104 of the respective one of reinforcement panels 1200 such that exterior surface 1104 of inner flap 1182 is aligned in a substantially face-to-face relationship with exterior surface 1104 of reinforcing panel 1200. In the example embodiment, each top side flap assembly 1170 is attached to the respective one of reinforcing panels 1200 using, for example, an adhesive, another suitable bonding material, fasteners, and/or any other suitable method for attaching panels.

Turning more specifically to FIG. 7, blank 1500 has a first or interior surface 1502 and an opposing second or exterior surface 1504. Further, blank 1500 defines a leading edge 1506 and an opposing trailing edge 1508. In one embodiment, blank 1500 includes, in series from leading edge 1506 to trailing edge 1508, a plurality of side panels (at least one of which may be referred to as "end panels"), including, specifically, a first rollover panel 1510, a first side panel 1512, a bottom panel 1514, a second side panel 1516, and a second rollover panel 1518 coupled together along preformed, generally parallel, fold lines 1520, 1522, 1524, and 1526 respectively. More specifically, first rollover panel 1510 extends between leading edge 1506 and fold line 1520, first side panel 1512 extends from fold line 1520, bottom panel 1514 extends from fold line 1522, second side panel 1516 extends from fold line 1524, and second rollover panel 1518 extends between fold line 1526 and trailing edge 1508. Fold line 1520 defines a top edge of first rollover panel 1510 and a top edge of first side panel 1512. Fold line 1522 defines a bottom edge of first side panel 1512 and a first side edge of bottom panel 1514. Fold line 1524 defines a bottom edge of second side panel 1516 and a second side edge of bottom panel 1514. Fold line 1526 defines a top edge of second rollover panel 1518 and a top edge of second side panel 1516. Fold lines 1520, 1522, 1524, and 1526 as well as other fold lines and/or hinge lines described herein, may include any suitable line of weakening and/or line of separation known to those skilled in the art and guided by the teachings herein provided.

In the example embodiment, first rollover panel 1510 and first side panel 1512 are substantially congruent and have a rectangular shape, second rollover panel 1518 and second side panel 1516 are substantially congruent and have a rectangular shape, and bottom panel 1514 has a substantially rectangular shape. Moreover, rollover panels 1510 and 1518 each have a height 1527, and side panels 1512 and 1516 each have a height 1529 that is slightly greater than height 1527 by approximately a thickness of blank 1500, to accommodate rollover panels 1510 and 1518 being positioned in an overlying relationship with side panels 1512 and 1516, respectively, when container 1700 (shown in FIG. 8) is formed from blank 1500. In alternative embodiments, first rollover panel 1510 and first side panel 1512 are other than substantially congruent, and/or second rollover panel 1518 and second side panel 1516 are other than substantially congruent. Moreover, in alternative embodiments, each of rollover panels 1510 and 1518 and side panels 1512 and 1516 have any suitable height that enables blank 1500 to function as described herein.

In the example embodiment, first rollover panel 1510 includes two free end edges 1530 and 1532, and second rollover panel 1518 includes two free end edges 1534 and 1536. First side panel 1512 includes two free end edges 1538 and 1540, and second side panel 1516 includes two free end edges 1542 and 1544. Free end edges 1530, 1532, 1534, 1536, 1538, 1540, 1542, and 1454 are generally parallel to each other. In alternative embodiments, free end edges 1530, 1532, 1534, 1536, 1538, 1540, 1542, and 1544 may be other than substantially parallel to each other.

A first end panel 1546 extends from bottom panel 1514 along a fold line 1548 to a fold line 1550, and a first top end flap 1552 extends from fold line 1550 to a free edge 1554. A second end panel 1556 extends from bottom panel 1514 along a fold line 1558 to a fold line 1560, and a second top end flap 1562 extends from fold line 1560 to a free edge 1564. Fold line 1548 defines a bottom edge of first end panel 1546 and a first end edge of bottom panel 1514. Fold line 1550 defines a top edge of first end panel 1546. Fold line 1558 defines a bottom edge of second end panel 1556 and a second end edge of bottom panel 1514. Fold line 1560 defines a top edge of second end panel 1556. In the example embodiment, first and second end panels 1546 and 1556 each have a generally rectangular shape, and each have a height 1563 that is approximately equal to height 1529. In the example embodiment, first and second top end flaps 1552 and 1562 each have a generally rectangular shape, and each have a width 1565 that is less than height 1563. In alternative embodiments, each of end panels 1546 and 1556 and each of top end flaps 1552 and 1562 have any suitable shape and height that enables blank 1500 to function as described herein.

A top side flap 1570 extends from each opposing side edge of each of top end flaps 1552 and 1562. Each side edge of top end flaps 1552 and 1562 is defined by a respective one of fold lines 1572, 1574, 1576, and 1578. In the example embodiment, fold lines 1572, 1574, 1576, and 1578 are generally parallel to each other and to fold lines 1520, 1522, 1524, and 1526. In alternative embodiments, fold lines 1572, 1574, 1576, and 1578 may be other than substantially parallel to each other and/or to fold lines 1520, 1522, 1524, and/or 1526. In the example embodiment, each top side flap 1570 is substantially similar and extends from a respective one of top end flaps 1552 and 1562 along one of fold lines 1572, 1574, 1576, and 1578 to a free edge 1586. In the example embodiment, each top side flap 1570 is substantially rectangular in shape. In alternative embodiments, each top side flap 1570 has any suitable shape that enables blank 1500 to function as described herein. Together, each of top end flaps 1552 and 1562 and the respective top side flaps 1570 define upper reinforcing assemblies. In other words, one upper reinforcing assembly includes top end flap 1552 and top side flaps 1570 extending along fold lines 1572 and 1574, and another upper reinforcing assembly includes top end flap 1562 and top side flaps 1570 extending along fold lines 1576 and 1578.

A reinforcing panel 1600 (or side reinforcing assembly) extends from each opposing side edge of each end panel 1546 and 1156. Each side edge of end panels 1546 and 1556 is defined by a respective one of fold lines 1602, 1604, 1606, and 1608. In the example embodiment, fold lines 1602, 1604, 1606, and 1608 are generally parallel to each other and to fold lines 1520, 1522, 1524, and 1526. In alternative embodiments, fold lines 1602, 1604, 1606, and 1608 may be other than substantially parallel to each other and/or to fold lines 1520, 1522, 1524, and/or 1526.

In the example embodiment, each reinforcing panel 1600 is substantially similar and extends from a respective one of end panels 1546 and 1556 along one of fold lines 1602, 1604, 1606, and 1608 to free end 1610. In the example embodiment, each reinforcing panel 1600 is substantially rectangular in shape. In alternative embodiments, reinforcing panels 1600 have any suitable shape that enables blank 1500 to function as described herein.

In the example embodiment, bottom panel 1514 has a depth 1621. End panels 1546 and 1556 each have a depth 1623 that is slightly shorter than depth 1621 such that each of end panels 1546 and 1556 is narrower than bottom panel 1514 by about twice a thickness of blank 1500. Further, each of side panels 1512 and 1516 and rollover panels 1510 and 1518 have a width 1625. Bottom panel 1514 has a width 1627 that is slightly longer than width 1625. In other words, each of fold lines 1602, 1604, 1606, and 1608 is offset or spaced apart from a respective one of fold lines 1522 and 1524 by a distance equal to approximately twice the thickness of blank 1500 to accommodate each outer reinforcing panel 1612 and inner reinforcing panel 1614 being coupled to exterior surface 1504 of respective side panels 1512 and 1516 when container 1700 is formed from blank 1500. Moreover, free end edges 1538, 1540, 1542, and 1544 of side panels 1512 and 1516 and rollover panels 1510 and 1518 are offset or spaced apart from fold lines 1548 and 1558 sufficiently to accommodate each inner reinforcing panel 1614 extending between the respective one of free end edges 1538, 1540, 1542, and 1544 and one of end panels 1546 and 1556 when container 1700 is formed from blank 1500. In alternative embodiments, each of bottom panel 1514, end panels 1546 and 1556, side panels 1512 and 1516, and rollover panels 1510 and 1518 have any suitable depth and width that enables blank 1500 to function as described herein.

In the example embodiment, reinforcing panels 1600 have a width 1629 such that when container 1700 is formed from blank 1500, each reinforcing panel 1600 is aligned in an overlying relationship with at least a portion of respective rollover panels 1510 and 1518. In alternative embodiments, each of reinforcing panel 1600 has any suitable width that enables blank 1500 to function as described herein. In the example embodiment, each reinforcing panel 1600 has a height 1633 that is less than height 1529 by about the thickness of blank 1500. At least a portion of an inner bottom edge 1636 of each reinforcing panel 1600 is positioned against interior surface 1502 of bottom panel 1514 when blank 1500 is erected to form container 1700. In alternative embodiments, each reinforcing panel 1600 has any suitable height that enables blank 1500 to function as described herein.

In the example embodiment, each top side flap 1570 has a width 1637 that is slightly larger than width 1565 by about the thickness of blank 500. Each top side flap 1570 has a height 1639 substantially equal to width 1637. In alternative embodiments, each top side flap 1570 has any suitable width and height that enables blank 1500 to function as described herein.

In the example embodiment, blank 1500 is fabricated from a corrugated cardboard material and includes a plurality of corrugations or flutes (not shown) therein, oriented parallel to a corrugation direction indicated at 1650. As described further herein, corrugation direction 1650 facilitates improved strength of container 1700.

In the example embodiment, a pair of cutouts 1652 is defined substantially entirely within each of first side panel 1512 and second side panel 1516. Each cutout 1652 is rectangular and sized slightly larger than top side flaps 1570, 1576, 1582, and 1588 such that top side flaps 1570 align with side panels 1512 and 1516 when blank 1500 is erected to form container 1700. In alternative embodiments, blank 1500 includes cutouts 1652 in any suitable number and configuration that enables blank 1500 and/or container 1700 to function as described herein.

Turning more specifically to FIG. 8, container 1700 includes a bottom wall 1702, a pair of opposing side walls 1704 and 1706, a pair of opposing end walls 1708 and 1710, and a pair of top walls 1712 and 1714 that oppose bottom wall 1702. In the example embodiment, each of the side walls 1704 and 1706 is generally perpendicular to each of end walls 1708 and 1710, each of the side walls 1704 and 1706 and end walls 1708 and 1710 is generally perpendicular to each of the top walls 1712 and 1714, and each of side walls 1704 and 1706 and end walls 1708 and 1710 is generally perpendicular to bottom wall 1702, such that container 1700 has a generally rectangular shape. In alternative embodiments, side walls 1704 and 1706, end walls 1708 and 1710, and bottom wall 1702 have any relative orientation that enables container 1700 to function as described herein. Side walls 1704 and 1706, end walls 1708 and 1710, and bottom wall 1702 cooperate to define cavity 1720 of container 1700.

In the example embodiment, bottom wall 1702 includes bottom panel 1514. First end wall 1708 includes first end panel 1546, and second end wall 1710 includes second end panel 1556. First top wall 1712 includes first top end flap 1552 and second top wall 1714 includes second top end flap 1562. First side wall 1704 includes first side panel 1512, first rollover panel 1510, reinforcing panel 1600 that extends from an edge defined along fold line 1604 of first end panel 1546, reinforcing panel 1600 that extends from an edge defined along fold line 1608 of second end panel 1556, top side flap 1570 that extends from an edge defined along fold line 1574 of top end flap 1552, and top side flap 1570 that extends from an edge defined along fold line 1578 of top end flap 1562. Accordingly, at least a portion of first side wall 1704 has a thickness approximately equal to three times the thickness of blank 1500. Second side wall 1706 includes second side panel 1516, second rollover panel 1518, reinforcing panel 1600 that extends from an edge defined along fold line 1602 of first end panel 1546, reinforcing panel assembly 1600 that extends from an edge defined along fold line 1606 of second end panel 1556, top side flap 1570 that extends from an edge defined along fold line 1572 of top end flap 1552, and top side flap 1570 that extends from an edge defined along fold line 1576 of top end flap 1562. Accordingly, at least a portion of second side wall 1706 has a thickness approximately equal to three times the thickness of blank 1500. More specifically, exterior surface 1504 of each reinforcing panel 1600 is in a substantially face-to-face relationship with exterior surface 1504 of the corresponding one of rollover panels 1510 and 1518.

Due to the corrugation direction 1650 of flutes within blank 1500, reinforcing panels 1600 have vertically oriented flutes when container 1700 is formed from blank 1500, thereby increasing a stacking strength of reinforcing structures 1721. By providing rollover panels 1510 and 1518 and reinforcing panels 1600, the example embodiment of container 1700 provides increased stacking strength in comparison to containers without rollover panels 1510 and 1518 and reinforcing panels 1600.

More specifically, exterior surface 1504 of each reinforcing panel 1600 is coupled to exterior surface 1504 of the corresponding one of rollover panels 1510 and 1518. In the example embodiment, interior surface 1502 of first rollover panel 1510 is positioned in a substantially face-to-face relationship with interior surface 1502 of first side panel 1512, and interior surface 1502 of second rollover panel 1518 is positioned in a substantially face-to-face relationship with interior surface 1502 of second side panel 1516. Further in the example embodiment, interior surface 1502 of each top side flap 1570 is positioned in a substantially face-to-face relationship with interior surface 1502 of the respective rollover panel 1510 and 1518 via cutout 1652.

Thus, in the example embodiment, at least a reinforced portion 1722 of each of side walls 1704 and 1706, adjacent each respective end wall 1708 and 1710, has a thickness defined by the respective one of rollover panels 1510 and 1518, the respective one of side panels 1512 and 1516, and the respective reinforcing structure 1721 (i.e., the respective reinforcing panel 1600), each extending from a bottom edge 1730 to a top edge 1732 of the respective side wall 1704 or 1706.

In the example embodiment, bottom panel 1514 is sized to correspond to product(s) contained within container 1700. Although container 1700 is shown as being formed without a product to be contained therein, container 1700 may also be formed around a product contained therein. Further, container 1700 may include any suitable number of products of any suitable shape.

To form container 1700 from blank 1500, each rollover panel 1510 and 1518 is rotated toward interior surface 1502 of each side panel 1512 and 1516, respectively, about fold lines 1520 and 1526, respectively, such that rollover panels 1510 and 1518 are aligned in a substantially face-to-face relationship with side panels 1512 and 1516. Each side panel 1512 and 1516 is rotated about fold lines 1522 and 1524, respectively, into a substantially perpendicular relationship with bottom panel 1514. Each reinforcing panel 1600 is rotated about at least one of fold lines 1602, 1604, 1606, and 1608 toward interior surface 1502 of the respective one of end panels 1546 and 1556 into a substantially perpendicular relationship with the respective one of end panels 1546 and 1556.

In the example embodiment, at least one of reinforcing panel 1600 and the respective end panel 1546 or 1556 are secured in the above-described relationships. Any of the panels may be attached using, for example, adhesive, another suitable bonding material, fasteners, and/or any other suitable method for attaching panels. Additionally or alternatively, at least one of reinforcing panel 1600 and the respective end panel 1546 or 1556 is maintained in the above-described relationships by a force applied by a machine and/or by hand.

First and second end panels 1546 and 1556 are rotated inwardly about fold lines 1548 and 1558, respectively, into a substantially perpendicular relationship with bottom panel 1514. Each reinforcing panel 1600 and a portion of a respective one of rollover panels 1510 and 1518 are aligned in a substantially face-to-face relationship. Each reinforcing panel 1600 is attached to the respective one of rollover panels 1510 and 1518 to form a container 1700. For example, an adhesive is applied to at least one of exterior surface 1504 of reinforcing panel 1600 and the respective exterior surface 1504 of one of rollover panels 1510 and 1518. Alternatively or additionally, reinforcement panel 1600 is attached to the respective one of rollover panels 1510 and 1518 using, for example, fasteners, another suitable bonding material, and/or any other suitable method for attaching panels.

Further in the example embodiment, each top end flap 1152 and 1562 is rotated inwardly about fold lines 1550 and 1560, respectively, into a substantially perpendicular relationship with the edge of the respective reinforcing panel assembly 1600. Moreover, each top side flap 1570 is rotated downwardly about respective fold lines 1572, 1574, 1576, and 1578 into a substantially face-to-face relationship with the respective one of rollover panels 1510 and 1518 via cutout 1652. In the example embodiment, each top side flap 1570 is attached to the respective one of rollover panels 1510 and 1518 using, for example, an adhesive, another suitable bonding material, fasteners, and/or any other suitable method for attaching panels. By rotating each top side flap 1570 into cutout 1652, the outer surface of container 1700 is substantially planar which provides an improved printing surface and reduces the number of possible "catch points" on the outside of container 1700.

The above-described embodiments provide a reinforced container that may be formed from a single blank of sheet material. The embodiments provide a blank that includes a reinforcing panel assembly, and a container formed from the blank that has reinforced end wall portions and reinforced side wall portions. The container provides enhanced corner stacking strength in combination with opposing end walls that each include two plies over substantially an entire extent of the end wall. In addition, each end wall presents a relatively smooth, planar interior surface.

Exemplary embodiments of a container formed to contain a product therein and blanks and methods for making the same are described above in detail. The blanks, the container, and the methods are not limited to the specific embodiments described herein, but rather, components of the blanks and/or the container and steps of the method may be utilized independently and separately from other components and steps of the method described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method for forming a container from a blank, the blank including a bottom panel, two opposing end panels each extending from an end edge of the bottom panel, two opposing side panels each extending from a side edge of the bottom panel, an upper reinforcing assembly at least partially extending from each end panel, and a side reinforcing assembly extending from opposing side edge of each end panel, the method comprising:

rotating each end panel inwardly into a substantially perpendicular relationship with the bottom panel;

rotating each side panel into a substantially perpendicular relationship with the bottom panel;

rotating the side reinforcing assembly into a substantially perpendicular relationship with one of the two end panels;

rotating the upper reinforcing assembly into a substantially perpendicular relationship with one of the two end panels;

securing the side reinforcing assembly and the upper reinforcing assembly to at least one of the two side panels to form the container;

wherein the side reinforcing assembly further includes an outer reinforcing panel and an inner reinforcing panel, said method further comprising rotating the inner reinforcing panel toward an interior surface of the outer reinforcing panel, said rotating aligning the inner reinforcing panel and the outer reinforcing panel in a substantially face-to-face relationship;

wherein the upper reinforcing assembly further includes a top end flap and a top side flap, said method further comprising rotating the top side flap into a substantially perpendicular relationship with the top end flap, said top end flap forming a top wall in a formed container that is substantially perpendicular to said one of the two end panels.

2. The method in accordance with claim 1, wherein the side reinforcing assembly further includes a reinforcing panel, said method further including securing the reinforcing panel to one of the two side walls.

3. The method in accordance with claim 1, wherein the top side flap comprises an outer flap, and wherein the upper reinforcing assembly further includes an inner flap, said method further comprising rotating the inner flap toward an interior surface of the outer flap, said rotating aligning the inner flap and the outer flap in a substantially face-to-face relationship.

4. The method in accordance with claim 1, wherein the blank further includes at least one rollover panel extending from a top edge of the side panel, said method further comprising rotating the at least one rollover panel toward an interior surface of the side panel, said rotating aligning the rollover panel and the side panel into a substantially face-to-face relationship.

* * * * *